US009917375B2

(12) United States Patent
Korva et al.

(10) Patent No.: US 9,917,375 B2
(45) Date of Patent: Mar. 13, 2018

(54) BROADBAND OMNI-DIRECTIONAL DUAL-POLARIZED ANTENNA APPARATUS AND METHODS OF MANUFACTURING AND USE

(71) Applicant: Pulse Finland OY, Oulunsalo (FI)

(72) Inventors: Heikki Korva, Tupos (FI); Kimmo Koskiniemi, Oulu (FI)

(73) Assignee: Pulse Finland OY, Oulunsalo (FI)

( * ) Notice: Subject to any disclaimer, the term of this patent is extended or adjusted under 35 U.S.C. 154(b) by 83 days.

(21) Appl. No.: 14/964,374

(22) Filed: Dec. 9, 2015

(65) Prior Publication Data

US 2017/0170573 A1 Jun. 15, 2017

(51) Int. Cl.

| | |
|---|---|
| ***H01Q 21/00*** | (2006.01) |
| ***H01Q 21/20*** | (2006.01) |
| ***H01Q 1/42*** | (2006.01) |
| ***H01Q 5/10*** | (2015.01) |
| ***H01Q 1/38*** | (2006.01) |
| ***H01Q 1/00*** | (2006.01) |
| ***H01Q 15/14*** | (2006.01) |
| ***H01Q 21/24*** | (2006.01) |

(Continued)

(52) U.S. Cl.

CPC ..... *H01Q 21/205* (2013.01); *H01Q 1/005* (2013.01); *H01Q 1/38* (2013.01); *H01Q 1/42* (2013.01); *H01Q 5/10* (2015.01); *H01Q 15/14* (2013.01); *H01Q 21/00* (2013.01); *H01Q 21/24* (2013.01); *H01Q 21/26* (2013.01); *H01Q 21/28* (2013.01)

(58) Field of Classification Search

CPC ..... H01Q 21/00; H01Q 1/38; H01Q 5/01; H01Q 1/42; H01Q 1/005; H01Q 5/10; H01Q 15/14; H01Q 21/205; H01Q 21/24; H01Q 21/26; H01Q 21/28

See application file for complete search history.

(56) References Cited

U.S. PATENT DOCUMENTS 5,707,723 A * 1/1998 Harrison ..... B29C 70/086 428/313.3

6,452,549 B1 * 9/2002 Lo ..... H01Q 9/28 343/700 MS (Continued)

*Primary Examiner* — Hoang Nguyen

(74) *Attorney, Agent, or Firm* — Gazdzinski & Associates, PC

(57) ABSTRACT

In-building dual-polarized antenna apparatus components, assemblies, and methods for manufacturing and utilizing the same. In one embodiment, the dual-polarized ceiling mount antenna apparatus comprises a multiple input, multiple output (MIMO) device and is constructed to meet one or more aesthetically-related design goals such as e.g., being visually appealing. Specifically, only the horizontally polarized antenna element of the exemplary MIMO apparatus is visible as the remainder of the MIMO antenna apparatus is hidden from view above a ceiling tile. Moreover, the radome of the horizontally polarized antenna element is manufactured from a substantially translucent polymer cover and includes a "thin" radiating mesh. Resident above the ceiling tile, and normally obscured from view, is a vertically polarized antenna element along with an optional reflector element. Performance characteristics of the MIMO antenna apparatus and methods of manufacturing and using the aforementioned MIMO antenna apparatus are also disclosed.

24 Claims, 19 Drawing Sheets

(51) Int. Cl.
*H01Q 21/26* (2006.01)
*H01Q 21/28* (2006.01)

(56) References Cited

U.S. PATENT DOCUMENTS

| | | | | |
|---|---|---|---|---|
| 8,988,296 | B2 | 3/2015 | Koskiniemi et al. | |
| 8,988,298 | B1 * | 3/2015 | Akhoondzadehasl | H01Q 21/00 343/700 MS |
| 9,209,526 | B2 * | 12/2015 | Gao | H01Q 9/26 |
| 2013/0229314 | A1 | 9/2013 | Kuehler et al. | |
| 2013/0285879 | A1 * | 10/2013 | Wheeler | H01Q 1/40 343/893 |
| 2015/0299025 | A1 | 10/2015 | Brown et al. | |
| 2015/0375246 | A1 | 12/2015 | Kalistaja et al. | |

* cited by examiner

BROADBAND OMNI-DIRECTIONAL DUAL-POLARIZED ANTENNA APPARATUS AND METHODS OF MANUFACTURING AND USE

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to antenna solutions and more particularly in one exemplary aspect to antenna solutions that include both polar and spatial diversity and that otherwise support one or more design goals such as e.g., being aesthetically pleasing in appearance.

DESCRIPTION OF RELATED TECHNOLOGY

Antennas in wireless communication networks are critical devices for both transmitting and receiving wireless signals with and without amplification. With the evolution of network communication technology migrating from less to more capable technology; e.g., third generation systems ("3G") to fourth generation systems ("4G") with higher power, the need for antennas which can clearly receive fundamental frequencies or signals with minimal distortion are becoming more critical. The distortion experienced during signal reception is due in large part to the by-products of the mixture of these fundamental signals. Passive intermodulation, or PIM, is the undesired by-products of these mixed signals, which can severely interfere and inhibit the efficiency of a network system's capability in receiving the desired signals. With higher carrier power levels experienced in today's modern wireless communication networks, low PIM antennas with a peak PIM performance (for instance, lower than about −155 decibels relative to the carrier ("dBc") for cellular network applications are desired (such as 3G (e.g., 3GPP, 3GPP2, and UMTS), HSDPA/HSUPA, TDMA, CDMA (e.g., IS-95A, WCDMA, etc.), GSM, WiMAX (802.16), Long Term Evolution ("LTE") and LTE-Advanced ("LTE-A"), etc.)).

While antenna topologies exist for providing wireless access within, for example, buildings, these prior art antennas are typically not aesthetically pleasing and offer limited performance capabilities. For example, omni-directional multiple-in multiple-out ("MIMO") antennas exist in the prior art; however, these prior art implementations typically have limited bandwidth. Specifically, these prior art implementations have MIMO branches that tend to only cover some of the main antenna operating band in order to minimize the antenna size. Moreover, polarization diversity is typically not used in existing implementations; rather, spatial diversity implementations (e.g., two vertical antenna elements) are implemented (typically so as to attempt to reduce the antenna size) using two vertical antenna elements that share a common ground plane; however, the below-ceiling height for such implementations is typically in excess of 100 mm (3.9 inches), thereby making the antenna project significantly from the plane of the ceiling or other surface to which it is mounted, and accordingly rendering it quite noticeable to even the casual observer. It also presents itself as a better target for e.g., the errant ladder or other tall item being carried by an individual.

Finally, these prior art implementations typically utilize a polymer radome that often needs to be painted in order to match the color of the surrounding surface onto which the antenna is ultimately mounted (e.g., a ceiling), thereby necessitating at least some aesthetic "customization" which takes additional time and effort during installation.

Accordingly, there is a need for apparatus, systems and methods that provide for one or more of a wider operating bandwidth, polarization and/or spatial diversity as well as a radome that is more aesthetically adapted. Moreover, a solution that improves upon antenna isolation between operating bands while providing a minimal level of distortion to the radiation pattern (i.e., making the antenna operate in a more omni-directional manner) is desirable as well.

SUMMARY

The aforementioned needs are satisfied herein by providing antenna apparatus, systems and methods that provides for, inter alia, wider operating bandwidth, polarization and/or spatial diversity and a radome that meets one or more aesthetic design goals (e.g., less spatially intrusive, requires no aesthetic customization prior to installation, etc.).

In a first aspect, an antenna apparatus is disclosed. In one embodiment, the antenna apparatus is configured as a multiple-in multiple-out (MIMO) antenna, and includes a vertically polarized antenna element; and a horizontally polarized antenna element. The horizontally polarized antenna element comprises a translucent material that gives at least a portion of the horizontally polarized antenna element an aesthetically appealing appearance of at least one exposed surface.

In a first variant, the horizontally polarized antenna element includes layers of material including a top radome layer, a bottom radome layer and a flexible printed circuit (FPC) layer disposed between the top and bottom radome layers.

In another variant, the top and bottom radome layers are secured to the FPC layer without the use of an adhesive.

In yet another variant, the horizontally polarized antenna element includes a radiator mesh disposed within a FPC layer.

In yet another variant, the radiator mesh includes a line width on the order of approximately thirty micrometers (30 μm) and a pitch on the order of approximately two thousand micrometers (2000 μm).

In yet another variant, the horizontally polarized antenna element includes a plurality of broadband array elements, each broadband array element including a plurality of low band dipole elements.

In yet another variant, the horizontally polarized antenna element further includes a plurality of high band apertures, each of the high band apertures being positioned between adjacently disposed low band dipole elements.

In yet another variant, a plurality of null filling dipole elements are included, each null filling dipole element being disposed within a respective one of the high band apertures.

In yet another variant, the vertically polarized antenna element includes a broadband conical dipole antenna element disposed within a radome stem.

In yet another variant, the radome stem of the vertically polarized antenna element is configured to be received and secured within a mounting hole of a ceiling tile.

In yet another variant, the vertically polarized antenna element is configured to be positioned above the bottom surface of the ceiling tile while the horizontally polarized antenna element is configured to be positioned below the bottom surface of the ceiling tile.

In a second embodiment, the antenna apparatus includes a vertically polarized antenna element and a horizontally polarized antenna element. The horizontally polarized antenna element includes a plurality of layers and further includes a plurality of features disposed within at least some of the plurality of layers. At least a portion of the plurality of layers are formed in part using a translucent polymer layer.

In one variant, the plurality of layers include: a top radome layer; a circuit board layer comprising a radiating mesh; a bottom radome layer; and a low PIM substrate layer.

In yet another variant, a coaxial feed element having an outer conductor and an inner conductor is disclosed. The outer conductor is electrically coupled to the circuit board layer and the inner conductor is electrically coupled to the low PIM substrate layer.

In a second aspect, a horizontally polarized antenna element is disclosed. In one embodiment, the horizontally polarized antenna element comprises a radiator mesh disposed on a translucent polymer structure.

In a third aspect, a vertically polarized antenna element is disclosed. In one embodiment, the vertically polarized antenna element includes a radome stem, a ground tube and a radiating element.

In a fourth aspect, a single-in single-out (SISO) antenna apparatus is disclosed. In one embodiment, the SISO antenna apparatus includes the aforementioned horizontally polarized antenna element. In an alternative embodiment, the SISO antenna apparatus includes the aforementioned vertically polarized antenna element.

In a fifth aspect, an antenna apparatus is disclosed. In one embodiment, the antenna apparatus is formed at least in part from a translucent polymer structure having a radiating element disposed therein.

In another embodiment, the antenna apparatus includes an antenna element formed from a plurality of layers and having a plurality of features disposed within at least some of the plurality of layers; wherein at least a portion of the plurality of layers are formed in part using a translucent polymer layer.

In a first variant, the plurality of layers of material comprises a top radome layer, a bottom radome layer and a circuit board layer disposed between the top and bottom radome layers.

In another variant, the top and bottom radome layers are configured to sandwich the circuit board layer without use of an adhesive.

In yet another variant, a low passive intermodulation (PIM) layer is disclosed, the low PIM layer disposed underneath both the top and bottom radome layers; wherein the low PIM layer includes one or more transmission lines disposed on a bottom surface thereof, the one or more transmission lines being coupled to a feed point.

In yet another variant, one or more open patch elements are disposed on a top surface of the low PIM layer, the top surface of the low PIM layer being more proximate to the circuit board layer than the bottom surface of the low PIM layer.

In yet another variant, a radiator mesh disposed on the circuit board layer is disclosed.

In a sixth aspect, methods of manufacturing the aforementioned antenna apparatus and aforementioned antenna elements are disclosed.

In a seventh aspect, methods of using the aforementioned antenna apparatus and aforementioned antenna elements are disclosed. In one embodiment, the method includes disposing a hole within a ceiling tile of a building; inserting at least a portion of an antenna apparatus within the hole; and securing the antenna apparatus to the ceiling tile such that at least a portion of the antenna apparatus is disposed above the ceiling tile and at least one other portion of the antenna apparatus is disposed below the ceiling tile.

In an eighth aspect, buildings which utilize the aforementioned antenna apparatus and aforementioned antenna elements are disclosed.

In a ninth aspect, performance characteristics associated with the aforementioned antenna apparatus and aforementioned antenna elements are disclosed.

Various objects, features, aspects and advantages of the inventive subject matter will become more apparent from the following detailed description of exemplary embodiments, along with the accompanying drawings.

BRIEF DESCRIPTION OF THE DRAWINGS

The features, objectives, and advantages of the disclosure will become more apparent from the detailed description set forth below when taken in conjunction with the drawings, wherein.

DETAILED DESCRIPTION

Figure 1:
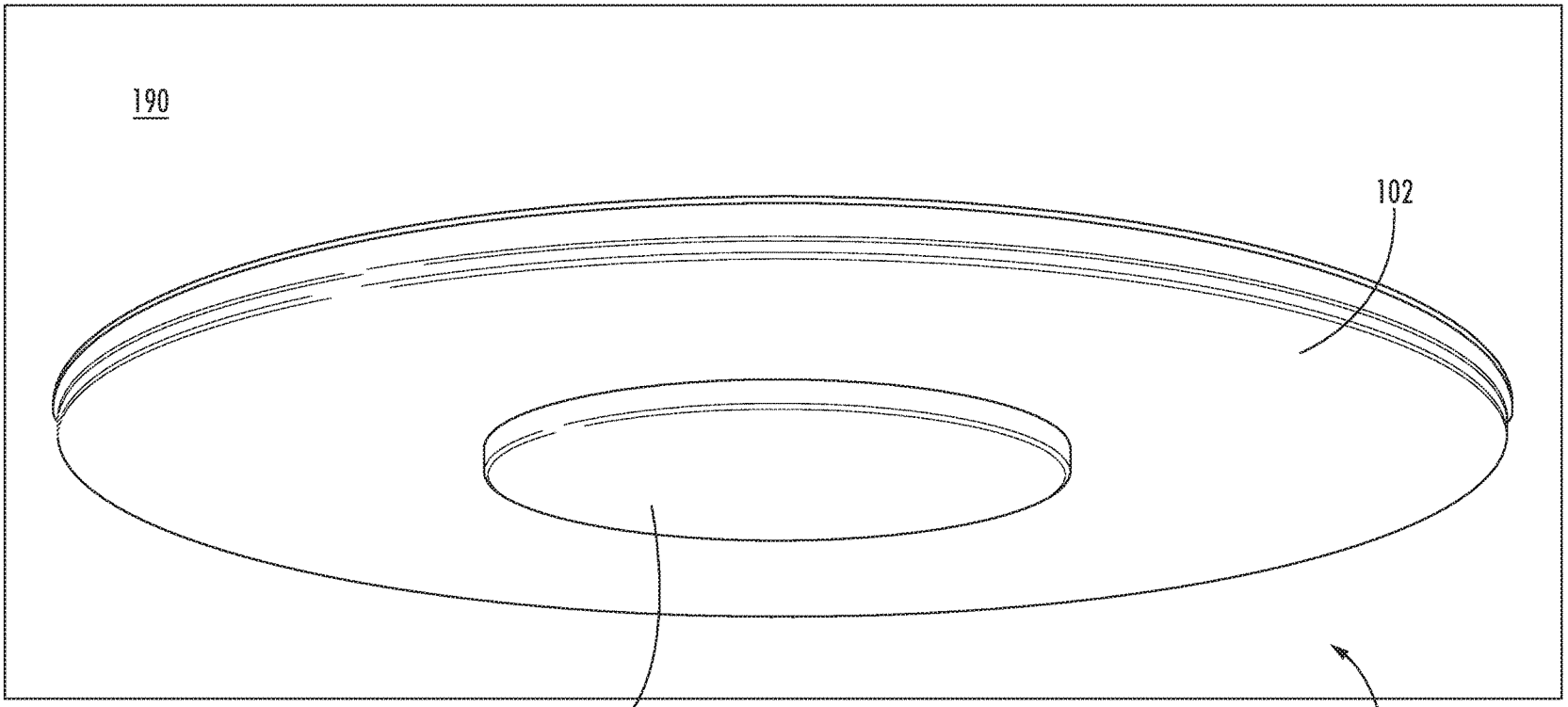
FIG. 1 is a perspective view of one embodiment of a translucent in-building broadband omni-directional dual-polarized ceiling mount MIMO antenna apparatus mounted within a ceiling tile in accordance with the principles of the present disclosure.

Reference is now made to the drawings wherein like numerals refer to like parts throughout.

As used herein, the term "aesthetic" refers without limitation to one or more features, attributes or facets of an appearance or presence of a component or assembly (e.g., an antenna assembly or component thereof). Aesthetic features, attributes or facets may be evaluated for example by the visual perception of an individual (e.g., customer or designer of the customer), a group of individuals (e.g., focus group), a pre-existing standard for appearance or desirability, and/or other metric or metrics, such that their desirability or level of aesthetic appeal can be readily ascertained by one of ordinary skill in the art given this disclosure.

As used herein, the term "antenna" refers without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the term "substrate" refers generally and without limitation to any substantially planar or curved surface or component upon which other components can be disposed. For example, a substrate may comprise a single or multi-layered printed circuit board (e.g., FR4), a semiconductive die or wafer, or even a surface of a housing or other device component, and may be substantially rigid or alternatively at least somewhat flexible.

Furthermore, as used herein, the terms "radiator," and "radiating element" refer without limitation to an element that can function as part of a system that receives and/or transmits radio-frequency electromagnetic radiation; e.g., an antenna. Hence, an exemplary radiator may receive electromagnetic radiation; transmit electromagnetic radiation, or both.

The term "feed" refers without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi (e.g., IEEE Std. 802.11 a/b/g/n/v/as), Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, Zigbee, Near field communication (NFC)/RFID, CDPD, satellite systems such as GPS and GLONASS, and millimeter wave or microwave systems.

Overview

The present disclosure provides for, inter alia, antenna apparatus for use in indoor wireless networks and, in one exemplary aspect, to improved in-building broadband omni-directional dual-polarized spatially diverse (e.g., MIMO) antenna apparatus components, assemblies, and methods for manufacturing and utilizing the same.

In an exemplary embodiment, the in-building broadband omni-directional dual-polarized ceiling mount MIMO antenna apparatus is constructed so as to meet one or more aesthetic or ornamental design goals, such as to be visually appealing in nature. Specifically, only the horizontally polarized antenna element of the MIMO apparatus is visible as the remainder of the MIMO antenna apparatus resides above the ceiling tile and is hidden from view. Moreover, the radome of the horizontally polarized antenna element is, in some embodiments, manufactured from a substantially translucent polymer cover which obviates the need to paint and/or otherwise color the radome cover in order to camouflage the antenna apparatus from the surrounding ceiling tile surface and includes a "thin" radiating mesh. Resident above the ceiling tile, and normally obscured from view, is a vertically polarized antenna element along with an optional reflector element that is, in an exemplary embodiment, manufactured from a conductive metal in order to steer the radiation of the antenna elements from the general direction of the ceiling towards the floor. In addition, the antenna elements of the MIMO antenna apparatus support both horizontal and vertical polarization diversity as well as spatial diversity for the antenna apparatus.

Performance characteristics of the exemplary MIMO antenna apparatus and methods of manufacturing and using the aforementioned MIMO antenna apparatus are also disclosed.

Exemplary Embodiments

Detailed descriptions of the various embodiments and variants of the apparatus and methods of the present disclosure are now provided. While primarily discussed in the context of a horizontally polarized antenna element manufactured from a translucent material, it is appreciated that alternative opaque material choices could be readily substituted. For example, embodiments are envisioned for the horizontally polarized antenna element described herein that are manufactured from opaque, more cost effective, polymer materials for the purposes of, inter alia, cost reduction.

Moreover, while primarily discussed in the context of exemplary MIMO antenna apparatus embodiments, it is appreciated that alternative variants of the antenna apparatus described herein can readily be modified for other antenna applications. For example, single-in single-out (SISO) antenna apparatus applications are also envisioned herein. As but one example, the vertically polarized antenna element may be obviated in certain embodiments, while aesthetically pleasing horizontally polarized antenna elements are provided. Moreover, in alternative embodiments, the horizontally polarized antenna element may be obviated in favour of the vertically polarized antenna elements in such SISO applications.

Finally, while primarily discussed in the context of ceiling embodiments in which the ceiling material itself is manufactured from a non-conductive material, it is appreciated that in applications in which the ceiling tiles themselves are conductive (e.g., manufactured from metal), both the horizontally polarized antenna element and vertically polarized antenna element will each now likely need to be mounted below the ceiling tile. Moreover, it is not necessarily a prerequisite that the antenna embodiments described herein are mounted within a ceiling. For example, it is appreciated that variants of the antenna apparatus described herein could be suitable for use in, for example, walls, floors, other structures, etc. These and other variants would be readily apparent to one of ordinary skill given the contents of the present disclosure.

Broadband Omni-Directional Dual-Polarized MIMO Antenna Apparatus—

Referring now to FIG. 1, one embodiment of an in-building broadband omni-directional dual-polarized ceiling mount MIMO antenna apparatus 100 is shown and described in detail. FIG. 1 illustrates the MIMO antenna apparatus mounted within a ceiling tile and demonstrates the low-profile, visually appealing nature of the ceiling mount MIMO-antenna for use with, inter alia, indoor radio networks. Preferably, the ceiling tile will be manufactured from a non-conductive material of the type generally well known in the art. Specifically, and as can be seen in FIG. 1, only the horizontally polarized antenna element 102 and accompanying opaque area/cap 104 are visible underneath the ceiling tile 190 with the remainder of the MIMO antenna apparatus being resident above the ceiling tile and hence, hidden from view. In certain embodiments of the present disclosure, the radome of the horizontally polarized antenna element is manufactured from a substantially translucent polymer cover which obviates the need to paint and/or otherwise color the radome in order to camouflage the antenna apparatus from the surrounding ceiling tile surface. Herein lies a salient advantage of the illustrated embodiment, namely that the translucent nature of the horizontally polarized antenna element naturally conforms to the underlying color of the ceiling tile to which the MIMO antenna apparatus is ultimately mounted. The underlying materials that make up embodiments of the horizontally polarized antenna element are described subsequently herein with respect to FIG. 1G. Moreover, in the illustrated implementation, only the opaque area/cap 104 is readily noticeable against the backdrop of the ceiling tile 190 thereby rendering the MIMO antenna apparatus 100 aesthetically appealing as compared with prior art implementations. However, it is also envisioned that in certain embodiments, cap 104 may itself be manufactured from translucent materials, whether in whole or in part. Again, while the horizontally polarized antenna element 102 is primarily described as being manufactured with a translucent polymer, it is appreciated that lower cost, non-translucent materials can be readily substituted in order to, inter alia, reduce the MIMO antenna apparatus overall cost.

Figure 1A:
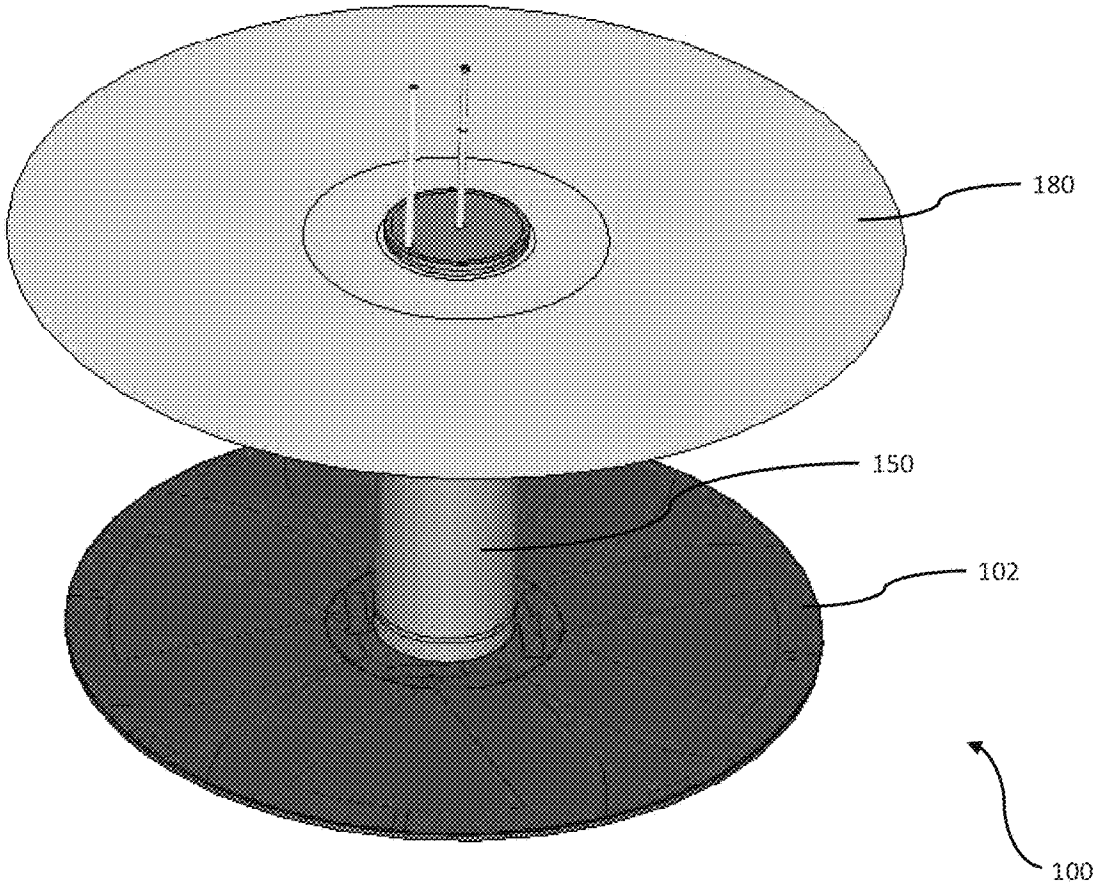
FIG. 1A is a perspective view of the MIMO antenna apparatus of FIG. 1, manufactured in accordance with the principles of the present disclosure.

FIG. 1A illustrates the MIMO antenna apparatus 100 of FIG. 1, with the ceiling tile removed from view in order to better illustrate the main components for the antenna apparatus. Specifically, the MIMO antenna apparatus illustrated includes a horizontally polarized antenna element 102 which typically resides underneath the ceiling tile. Typically resident above the ceiling tile, and normally obscured from view, is a vertically polarized antenna element 150 along with an optional reflector element 180 that is, in an exemplary implementation, manufactured from a conductive metal in order to steer the radiation of the antenna elements 102, 150 from the general direction of the ceiling towards the floor. While exemplary embodiments of the reflector element 180 are manufactured from a conductive metal material, it is appreciated that this reflector element could, in alternative embodiments, be manufactured from a conductively plated polymer material using well-known manufacturing techniques such as laser direct structuring (LDS) described in co-owned U.S. Pat. No. 8,988,296 filed Apr. 4, 2012 and entitled "Compact Polarized Antenna and Methods", the contents of which are incorporated herein by reference in its entirety. Alternative variants can be manufactured using deposition techniques such as those described in co-pending U.S. patent application Ser. No. 13/782,993 filed Mar. 1, 2013 and entitled "Deposition Antenna Apparatus and Methods"; co-owned and co-pending U.S. patent application Ser. No. 14/620,108 filed Feb. 11, 2015 and entitled "Methods and Apparatus for Conductive Element Deposition and Formation"; and co-owned and co-pending U.S. patent application Ser. No. 14/736,040 filed Jun. 10, 2015 of the same title, the contents of each of the foregoing being incorporated herein by reference in its entirety.

Of note is that the optional conductive reflector 180 is not necessarily galvanically connected to the underlying antenna elements and may, in certain embodiments, be snapped onto the vertically polarized antenna element 150 once the MIMO antenna apparatus 100 has been mounted onto a ceiling tile thereby obviating complicated installation techniques. However, it is appreciated that the conductive reflector can be coupled to the vertically polarized antenna element via other known techniques including, for example, by threading the conductive reflector onto the vertically polarized antenna element or via the use of epoxy-based attachment techniques and even, in some variants, via the use of welding, brazing and/or combinations of the foregoing.

Figure 1B:
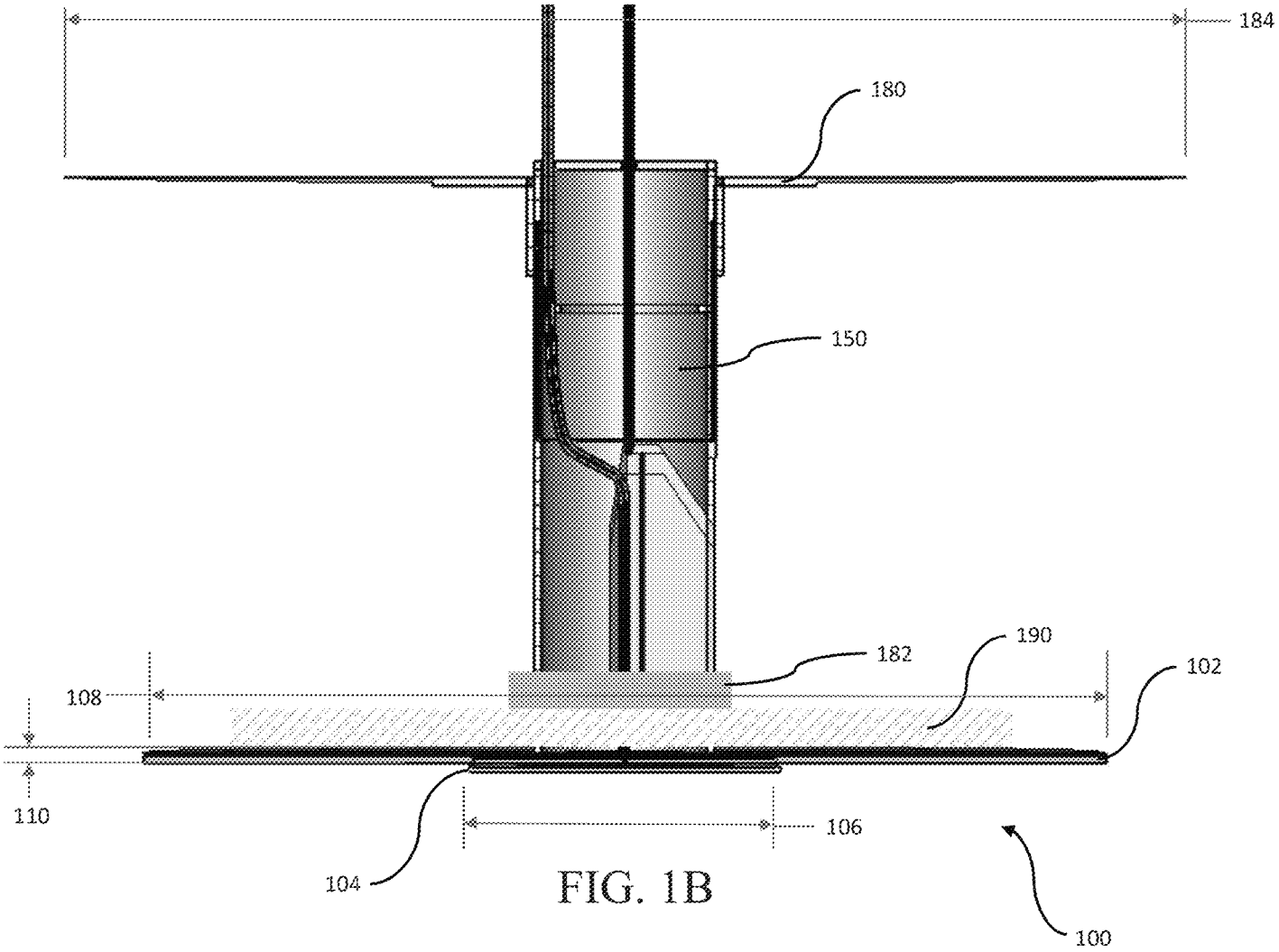
FIG. 1B is a front plan view of the MIMO antenna apparatus of FIG. 1 shown mounted to a ceiling tile in accordance with the principles of the present disclosure.

Referring now to FIG. 1B, a front plan view of the MIMO antenna apparatus 100 is shown mounted onto a ceiling tile 190. As illustrated in FIG. 1B, the horizontally polarized antenna element 102 is shown below the ceiling tile 190 such that it is only this antenna element 102 along with the opaque area/cap 104 that is visible from within a room in which the MIMO antenna apparatus 100 is mounted. The MIMO antenna apparatus is secured to the ceiling tile, in the illustrated embodiment, by virtue of a mounting nut 182 that is threaded onto the vertically polarized antenna element 150. The amount/length of threading (not shown) on the vertically polarized antenna element is preferably chosen so as to enable the MIMO antenna apparatus to be incorporated onto a number of different standard thickness ceiling tiles in order to ease installation for installers of these devices. Alternative implementations are also envisioned. For example, in certain implementation, snap features (not shown) are located on the vertically polarized element such that the antenna apparatus 100 can be inserted into the ceiling tile hole where the snap features engage, and prevent its ready removal. Moreover, in yet other implementations, antenna element 102 is rotatable about the center axis of antenna element 150. This rotation enables protruding portions to exit from antenna element 150 into and/or above the ceiling tile, thereby securing the antenna apparatus 100 in place. In yet other implementations, an adhesive, etc. could be applied to the top side of antenna element 102 or the vertical walls of antenna element 150 in order to secure the antenna apparatus to the ceiling tile. Moreover, the optional metal reflector 180 is, in an exemplary implementation, installed onto the vertically polarized antenna element 150 after installation of the antenna elements 102, 150 onto the ceiling tile in order to ease installation, although this is by no means a requirement for practicing embodiments of the present disclosure. Various dimensions and advantages over prior art implementations are now described.

Current indoor radio network antennas that support low band operation (e.g., 608 MHz and higher) are typically large in diameter and extend up to 150 mm (5.9 inches) below the surface of the ceiling tile. Contrast this dimension with that illustrated in FIG. 1B. In the illustrated embodiment, the horizontally polarized antenna element 102 possesses a visible height 110 of less than 10 mm (0.4 inches) below the surface of the ceiling tile 190. Moreover, the horizontally polarized antenna element possesses a diameter 108 of 350 mm (13.8 inches) with the opaque area/cap 104 possessing a diameter 106 of 114 mm (4.5 inches). The diameter of the vertically polarized antenna element 150 is, in the illustrated embodiment, approximately 66 mm (2.6 inches). The diameter 184 of the optional metal reflector 180 is, in the illustrated embodiment, 450 mm (17.7 inches) and the distance between the bottom surface of the ceiling tile to the metal reflector 180 is approximately 210 mm (8.3 inches). A MIMO antenna apparatus with the above-described dimensions can readily support frequencies from 608 MHz to 2700 MHz with full MIMO support. In addition, the antenna elements 102, 150 support both horizontal and vertical polarization, respectively which enables, inter alia, polarization diversity as well as spatial diversity for the antenna apparatus. Moreover, while the above-illustrated dimensions are exemplary, it is appreciated that the dimensions may be varied in alternative embodiments. For example, the overall size of the MIMO antenna apparatus 100 can be scaled smaller, i.e. the length of the vertically polarized antenna element 150 can be shortened and/or the diameter of the horizontally polarized antenna element decreased, if the lowest operating band is increased (i.e., to frequencies greater than 608 MHz).

Figure 1C:
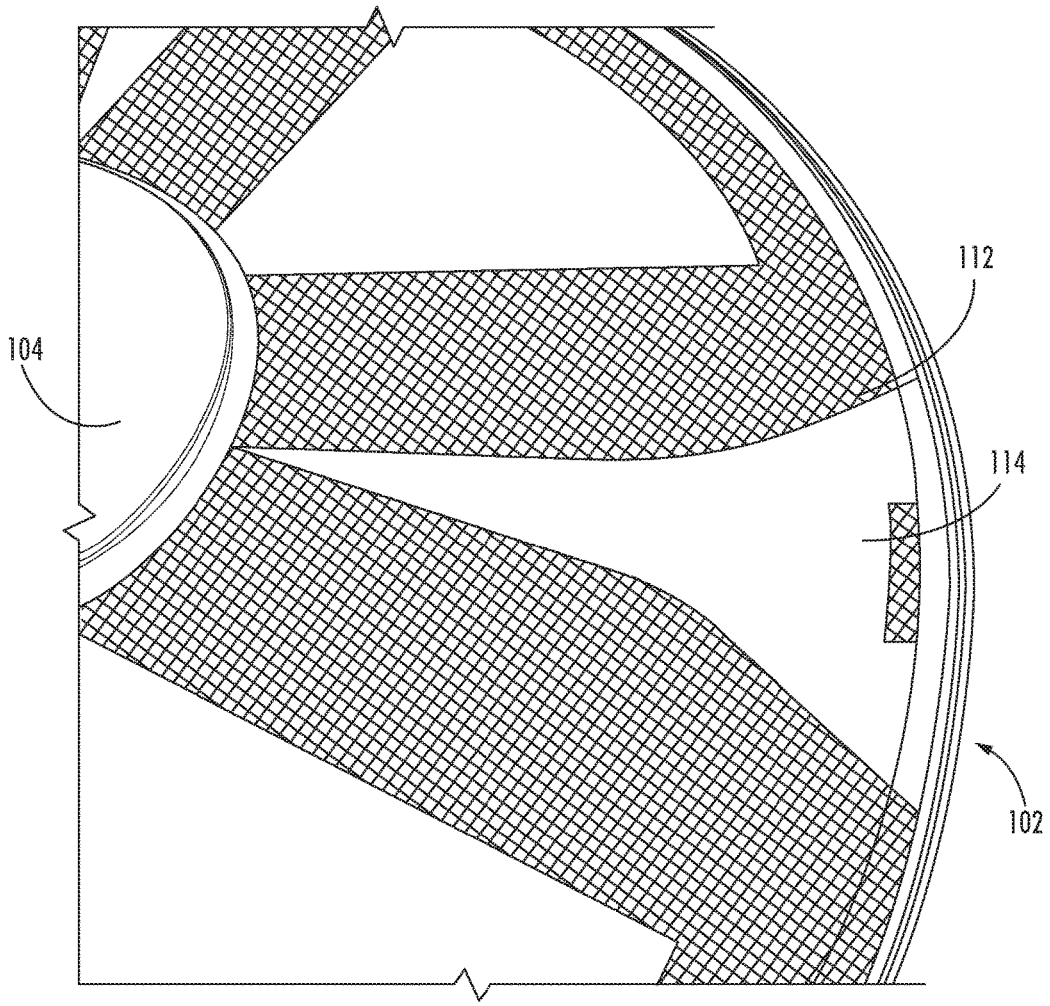
FIG. 1C is a detailed perspective view of the horizontally polarized antenna element of the MIMO antenna apparatus of FIG. 1A, illustrating the mesh incorporated therein, in accordance with the principles of the present disclosure.

Referring now to FIG. 1C, a detailed perspective view of the horizontally polarized antenna element 102 of the MIMO antenna apparatus of FIG. 1A is illustrated demonstrating the mesh 112 incorporated therein. In one exemplary embodiment, the translucent mesh material is manufactured by etching away a copper plated polyethylene terephthalate (PET) substrate. In the illustrated embodiment, the mesh (also illustrated in FIGS. 1D-1F) possesses a line width of 30 μm with a pitch of 2000 μm, although it is appreciated that that these dimensions may be varied in alternative implementations. For example, the choices of line width and pitch parameters are generally speaking, resultant from a tradeoff between optical transparency and antenna radiation efficiency. Accordingly, increasing the pitch greater than 2000 μm and decreasing line width below 30 μm will generally result in a reduction of the antenna radiation efficiency. Moreover, removing the mesh altogether such that these meshed areas now include solid radiating elements will result in less optical transparency. These and other design choices would be readily apparent to one of ordinary skill given the contents of the present disclosure.

Figure 1D:
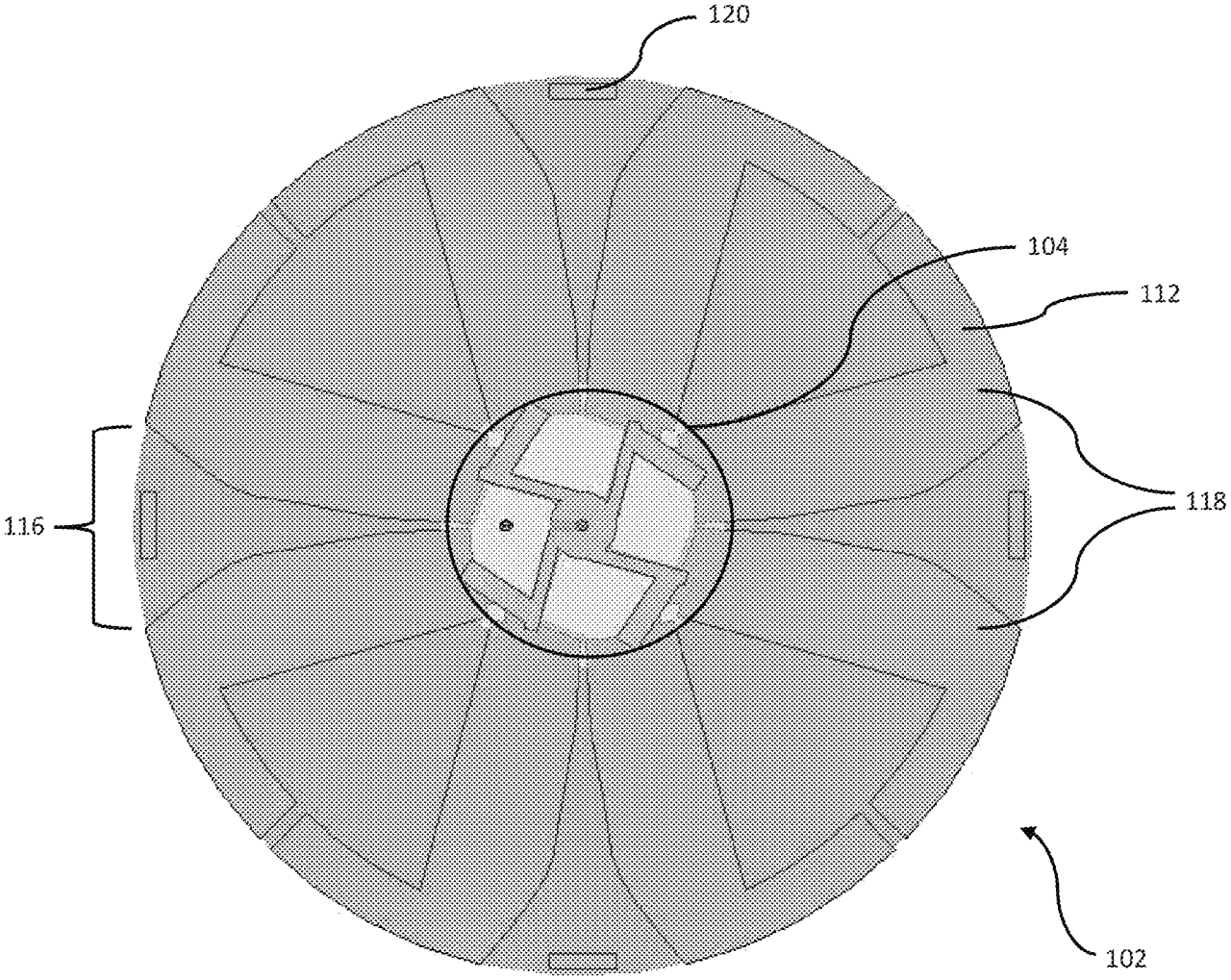
FIG. 1D is a top plan view of the horizontally polarized antenna element illustrated in FIG. 1C in accordance with the principles of the present disclosure.

Referring now to FIG. 1D, a top plan view of the exemplary horizontally polarized antenna element illustrated in FIG. 1C is shown and described in detail. Note that in the illustrated embodiment of FIG. 1D, the translucent nature of the cover has been made opaque in order to more readily see the outline of the previously described mesh 112 and other features/geometry of the horizontally polarized antenna element 102. As shown, the horizontally polarized antenna element consists of a four (4) element broadband array, each element consisting of two (2) low band dipole branches 118. In one exemplary embodiment, the opaque area/cap 104 includes a 50 Ohm feed point along with power splitter/impedance transformers that are built within this area, although it is appreciated that other impedances may be readily substituted depending upon the particular application for the antenna apparatus. In the illustrated embodiment, low band operation is formed by the perimeter dipole branches 118, while the high band is formed by the high band aperture 116 that formed between these low band dipole branches 118. In the illustrated embodiment, the high band aperture comprises a Vivaldi-style slot. Vivaldi-style antennas are advantageous in that their broadband characteristics are suitable for ultra-wideband signals. In addition, they are relatively simple to manufacture and they're easily impedance matched to the feeding line using micro-strip line modeling methods. In addition, an additional null filling dipole 120 (e.g., a 2.7 GHz null filling dipole) is added in order to make the highest frequency horizontal plane radiation pattern more omnidirectional in nature (see also FIG. 7D discussed infra).

Figure 1E:
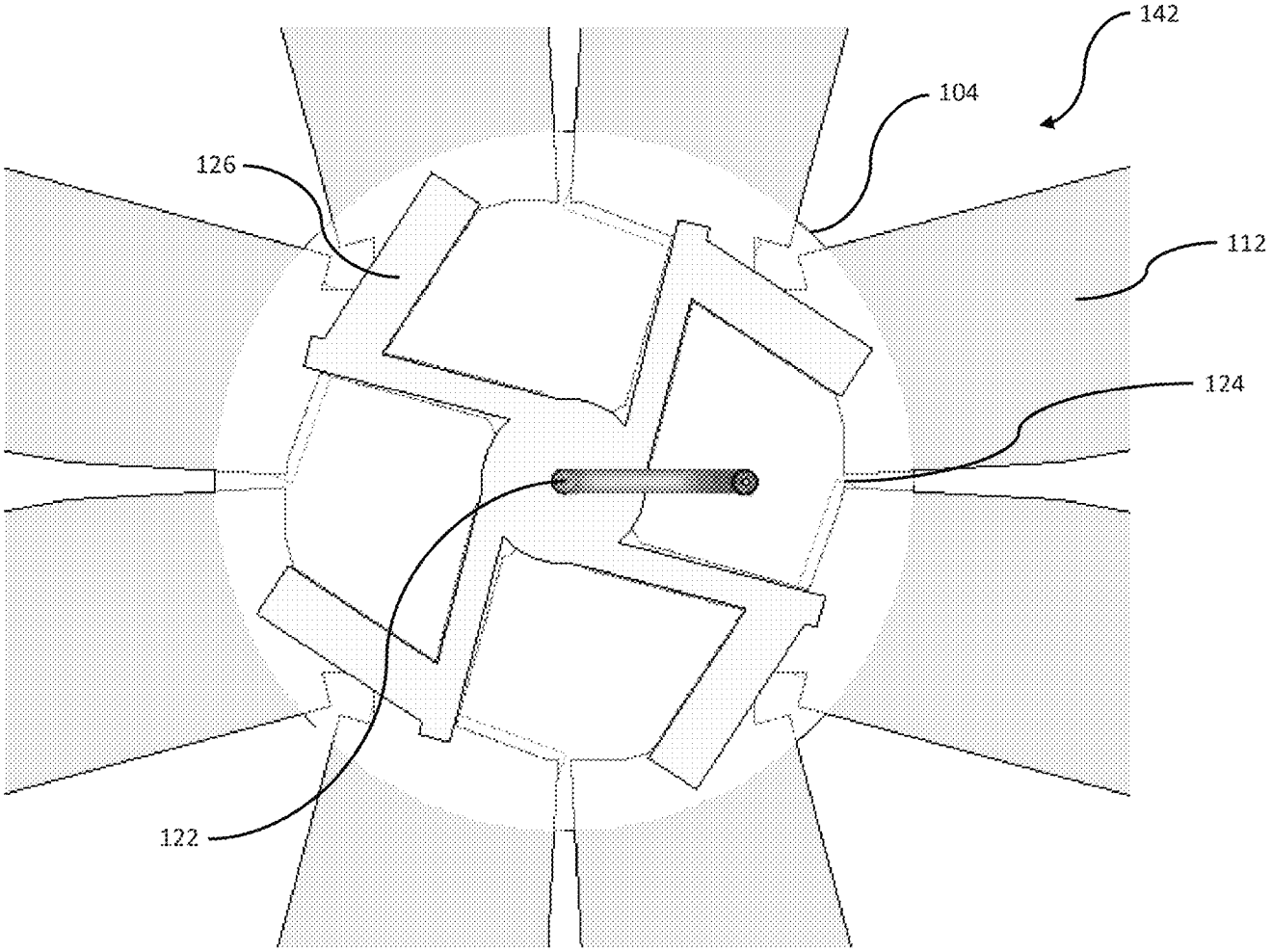
FIG. 1E is a detailed top plan view of the feed structure for the horizontally polarized antenna element illustrated in FIG. 1D in accordance with the principles of the present disclosure.

Referring now to FIG. 1E, a detailed top plan view of the feed structure 142 for the horizontally polarized antenna element is illustrated. In the illustrated embodiment, the horizontally polarized antenna element feed includes a coaxial feed. The outer conductor 122 of the coaxial feed is soldered to a flexible printed circuit ("FPC") manufactured from, for example, a polyimide ("PI") type polymer. See also FIG. 1G discussed subsequently herein. The feed structure 142 includes four elbow-like structures that radiate outward from the antenna element feed. This feed structure includes a capacitive ground 126 for each antenna element 112. In one exemplary embodiment, the capacitive ground 126 is manufactured from an etched opaque copper pattern on a PI substrate. However, in alternative variants it is appreciated that the capacitive ground may be manufactured using deposition manufacturing techniques such as those disclosed in co-pending U.S. patent application Ser. No. 13/782,993 filed Mar. 1, 2013 and entitled "Deposition Antenna Apparatus and Methods"; co-owned and co-pending U.S. patent application Ser. No. 14/620,108 filed Feb. 11, 2015 and entitled "Methods and Apparatus for Conductive Element Deposition and Formation"; and co-owned and co-pending U.S. patent application Ser. No. 14/736,040 filed Jun. 10, 2015 of the same title, the contents of each of the foregoing incorporated supra. Note that in the illustrated embodiment, this capacitive ground structure doesn't overlap the pattern feed points 124. In other words, as the Vivaldi-style patterns in the illustrated embodiment of FIG. 1D are essentially illustrated as a tapered open ended slot on the ground plane of the antenna (i.e., the translucent mesh 112 in this instance), the outer conductor 122 of the coaxial feed needs to be coupled to this mesh. Accordingly, in operation, the Vivaldi pattern is excited by a shorted transmission feed line (128, FIG. 1F) crossing the Vivaldi slot and terminating to the translucent mesh surface on the opposite side of the slot using open patch elements (125, FIG. 1F).

Figure 1F:
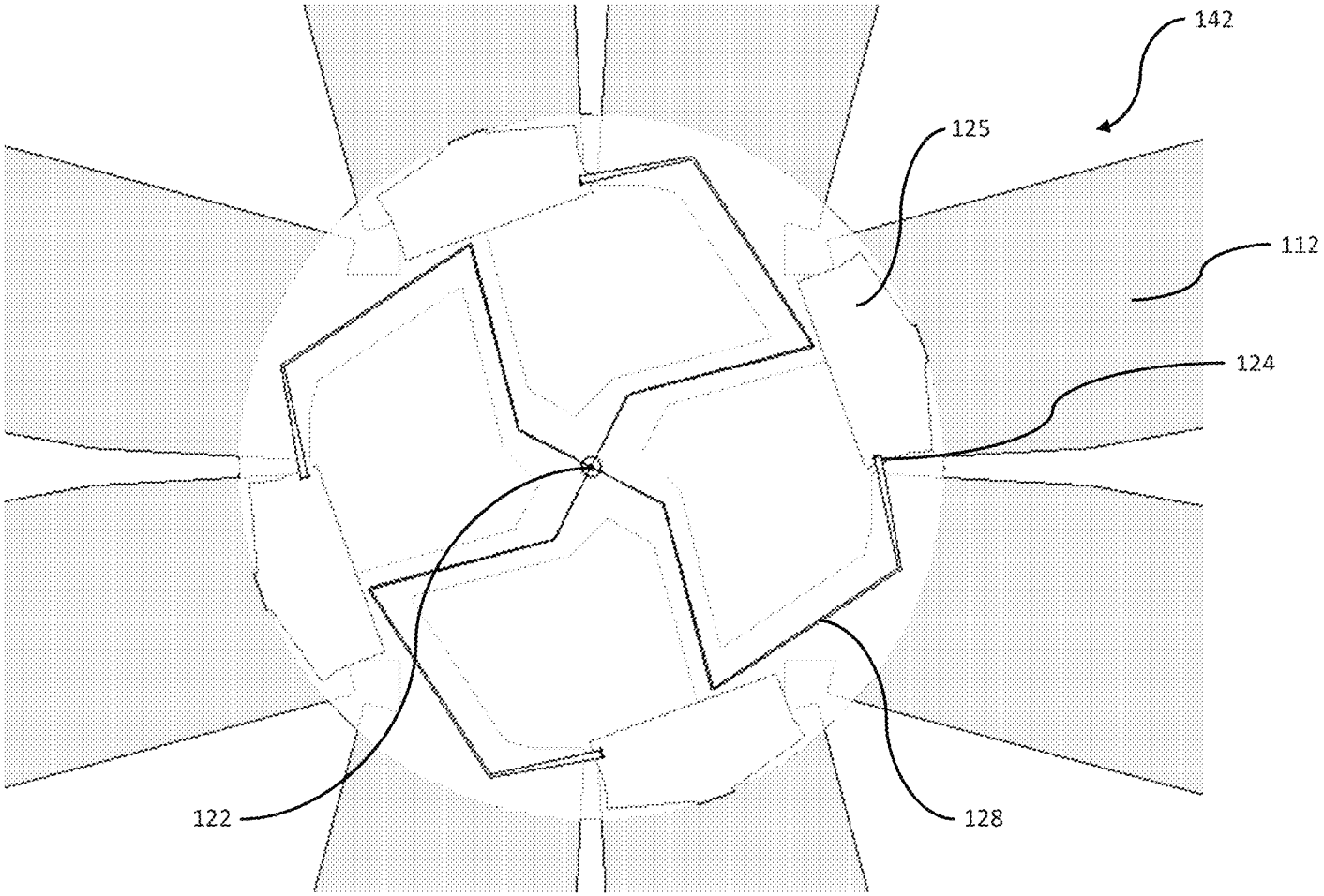
FIG. 1F is a detailed bottom plan view of the feed structure for the horizontally polarized antenna element illustrated in FIG. 1E in accordance with the principles of the present disclosure.

Referring now to FIG. 1F, a detailed bottom plan view of the feed structure 142 for the horizontally polarized antenna element illustrated in FIG. 1E is shown and described in detail. In the illustrated embodiment, the coaxial feed 122 center wire is soldered onto a low passive intermodulation ("PIM") substrate. See also FIG. 1G discussed subsequently herein. In addition, feed lines 128 are illustrated running from the coaxial feed 122 to each pattern feed point 124. In one exemplary embodiment, feed lines 128 are manufactured from an etched opaque copper pattern on a two sided low PIM substrate. However, alternatively it is appreciated that feed lines 128 may be manufactured using deposition manufacturing techniques such as those disclosed in co-pending U.S. patent application Ser. No. 13/782,993 filed Mar. 1, 2013 and entitled "Deposition Antenna Apparatus and Methods"; co-owned and co-pending U.S. patent application Ser. No. 14/620,108 filed Feb. 11, 2015 and entitled "Methods and Apparatus for Conductive Element Deposition and Formation"; and co-owned and co-pending U.S. patent application Ser. No. 14/736,040 filed Jun. 10, 2015 of the same title, the contents of each of the foregoing incorporated supra.

In one exemplary implementation, the pattern feed point 124 comprises a plated via hole connecting respective feed lines 128 to open patch elements 125. These feed lines form a power combining network for the horizontally polarized antenna element. These feed lines further are terminated with high capacitive coupling (open patch elements 125 located at the end of the feed lines) to the translucent radiator mesh 112. These open patch elements 125 are, in an exemplary embodiment, manufactured from an etched opaque copper pattern located on the bottom side of a low PIM laminate. However, in alternative embodiments, these open patch elements may be manufactured using deposition manufacturing techniques such as those disclosed in co-pending U.S. patent application Ser. No. 13/782,993 filed Mar. 1, 2013 and entitled "Deposition Antenna Apparatus and Methods"; co-owned and co-pending U.S. patent application Ser. No. 14/620,108 filed Feb. 11, 2015 and entitled "Methods and Apparatus for Conductive Element Deposition and Formation"; and co-owned and co-pending U.S. patent application Ser. No. 14/736,040 filed Jun. 10, 2015 of the same title, the contents of each of the foregoing incorporated supra.

Figure 1G:
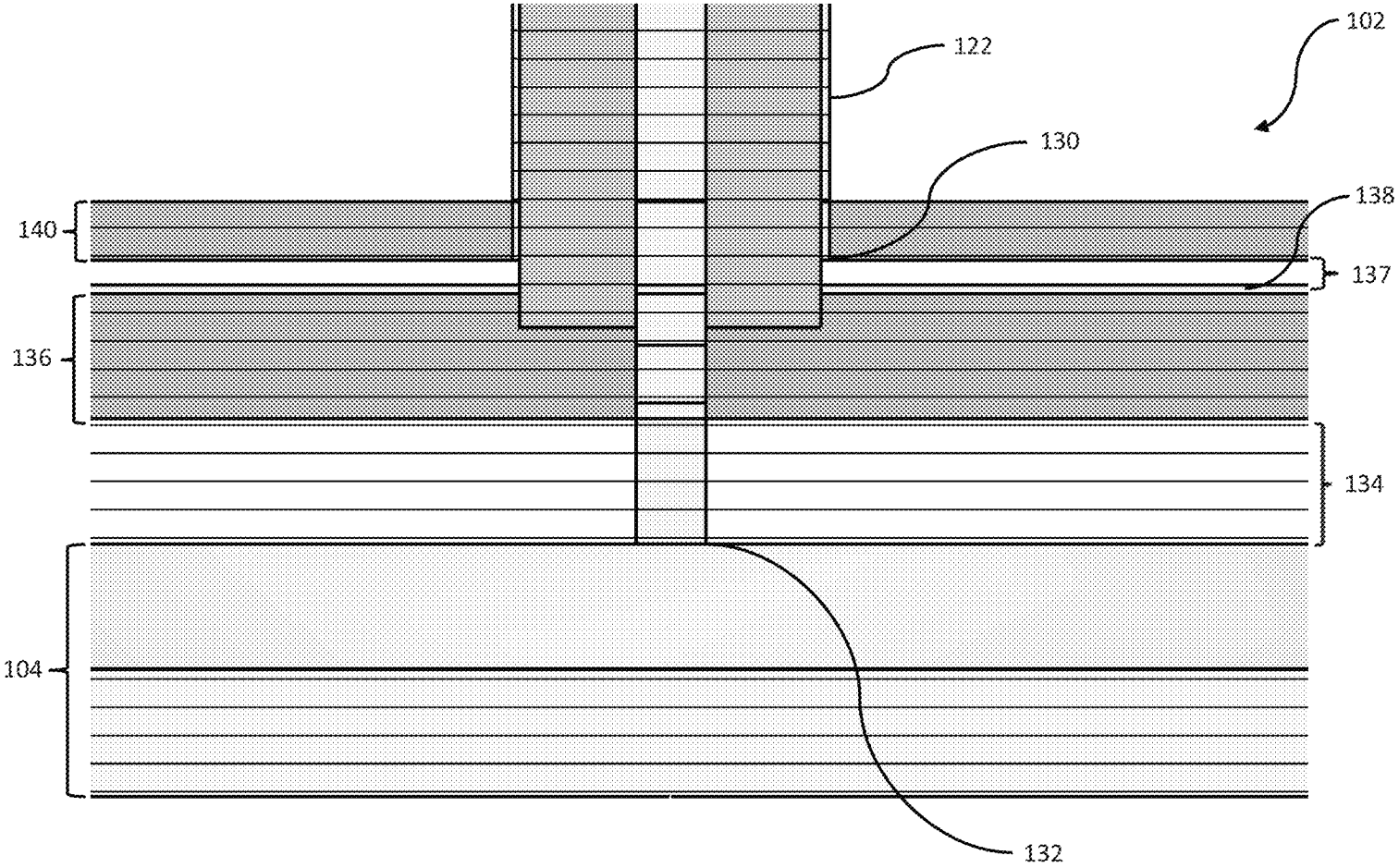
FIG. 1G is a detailed cross sectional view of the horizontally polarized antenna element illustrated in FIGS. 1C-1F in accordance with the principles of the present disclosure.

Referring now to FIG. 1G, a detailed cross sectional view of the horizontally polarized antenna element 102 in FIGS. 1C-1F is illustrated. In the illustrated embodiment, the coaxial feed 122 outer conductor is soldered to solder point 130 located on FPC layer 137. FPC layer 137 also includes, in an exemplary embodiment, capacitive ground (126, FIG. 1E) as well as the horizontally polarized antenna element coaxial feed outer conductor (122, FIG. 1E). In one exemplary implementation, the FPC layer 137 is manufactured from PI, although it is appreciated that other polymer materials may be readily substituted. The FPC layer 137 is, in the illustrated embodiment, glued to a translucent FPC layer 138. Translucent FPC layer 138 includes, in an exemplary embodiment, translucent radiator mesh (112, FIGS. 1E, 1F), high band apertures (116, FIG. 1D), dipole branches (118, FIG. 1D) and null filling dipole (120, FIG. 1D).

The radiator of the horizontally polarized antenna element is contained within this translucent FPC layer 138 with no galvanic contact to the coaxial wire outer conductor 122. Polymer layer 134 includes, in an exemplary embodiment, feed lines (128, FIG. 1F) and open/capacitive patch elements (125, FIG. 1F). Polymer layers 136, 140 effectively sandwich these FPC layers 137, 138. In one exemplary implementation, polymer layers 136, 140 effectively sandwich FPC layers 137, 138 without the use of an adhesive. Herein lies a salient advantage of the horizontally polarized antenna element 102. By obviating the use of adhesives in order to join layers 136, 140 to FPC layers 137, 138, resultant air bubbles are avoided leading to an aesthetically pleasing surface that for the portion of the MIMO antenna apparatus that is visible underneath the surface of a mounting surface, such as an exemplary ceiling tile.

In one exemplary embodiment, the polymer layer 136 consists of a clear polycarbonate ("PC") polymer that forms the bottom radome for the antenna element 102. Moreover, polymer layer 140, similar to polymer layer 136, consists of a clear PC polymer in one exemplary embodiment and forms the top radome for the antenna element 102. While the use of a clear PC material is exemplary, it is appreciated that polymer layers 136, 140 can be formed from other polymer materials whether consisting of the same type of polymer material or differing polymer materials. Layer 134 consists of a PCB substrate, such as a low PIM substrate, in which the center conductor for the coax cable is coupled at inner conductor solder joint 132. The low PIM substrate consists of a two-sided substrate thereby forming a through-hole via for attachment to the center conductor of the coax cable via the use of known attachment techniques such as, a eutectic solder, a conductive adhesive, etc. Bottom layer 104 consists of the opaque area/cap 104 disposed on the underside of the horizontally polarized antenna element 102.

Figure 1H:
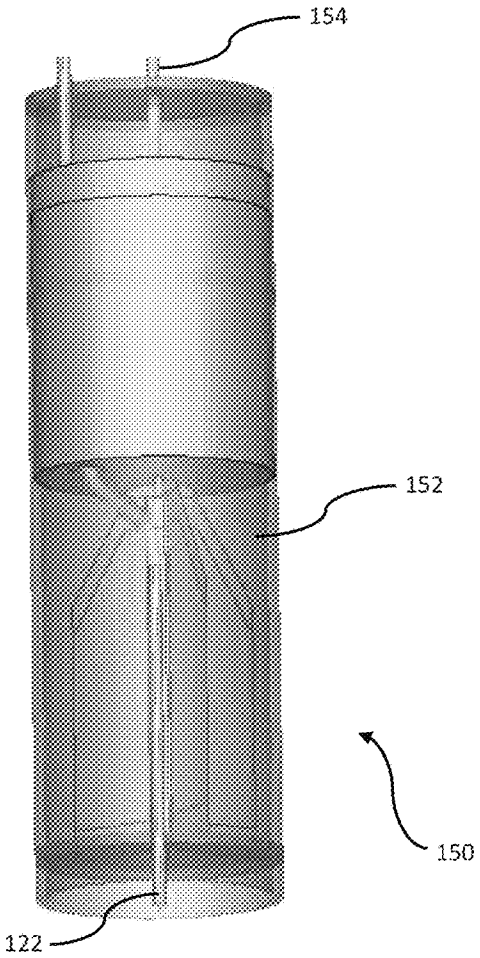
FIG. 1H is a perspective view of the vertically polarized antenna element of the MIMO antenna apparatus of FIG. 1A in accordance with the principles of the present disclosure.

Referring now to FIG. 1H, a perspective view of the vertically polarized antenna element of the MIMO antenna apparatus 100 illustrated in FIG. 1A is shown and described in detail. The vertically polarized antenna element is fed by a coaxial cable 154 that is separate and apart from coaxial cable 122 that feeds the horizontally polarized antenna element 102. The vertically polarized antenna element is housed within a polymer radome/stem 152. In one exemplary embodiment, the polymer radome/stem is manufactured from a flame retardant PC material which, in an exemplary embodiment, remains opaque in order to reduce costs associated with the MIMO antenna element. Specifically, the choice of an opaque material in the exemplary embodiment is able to reduce the higher costs associated with translucent polymers as the polymer radome/stem is otherwise concealed within a ceiling tile to which the polymer radome/stem is otherwise attached. The translucent nature of the radome/stem illustrated in FIG. 1H is merely chosen to illustrate the contents contained therein, although it is readily appreciated that the radome/stem may be manufactured from a translucent polymer in alternative embodiments.

Figure 1I:
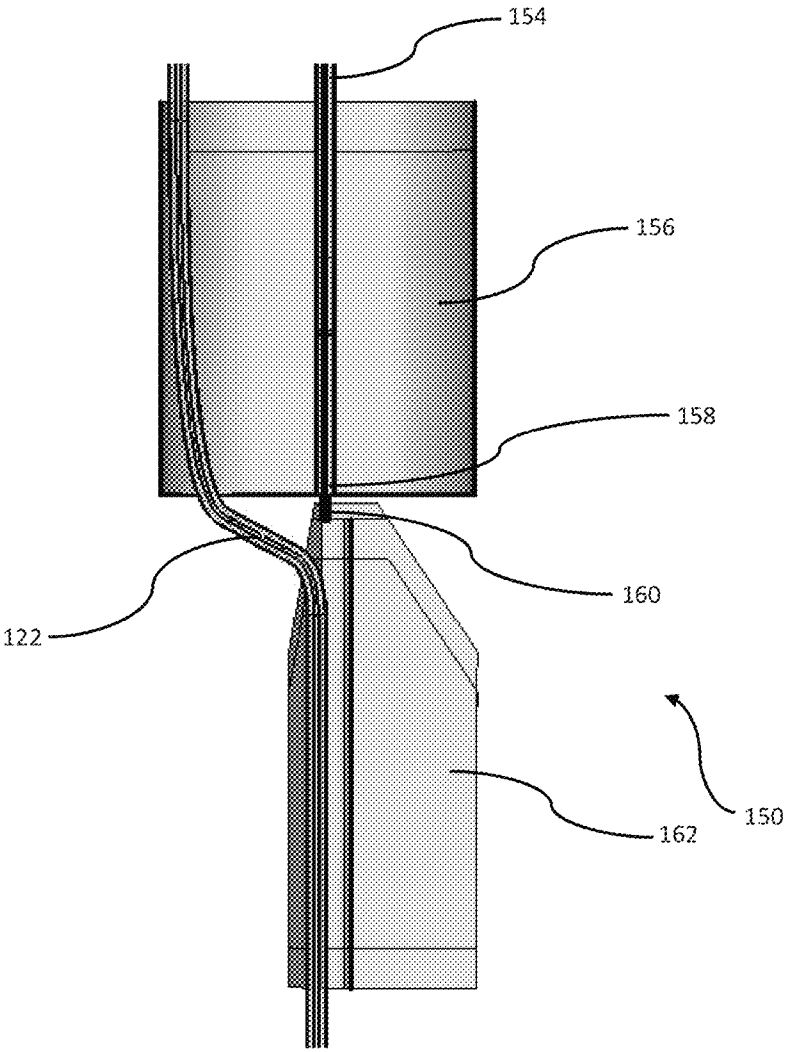
FIG. 1I is a front plan view of the vertically polarized antenna element of FIG. 1H with the stem removed from view in accordance with the principles of the present disclosure.

Referring now to FIG. 1I, a front plan view of the vertically polarized antenna element of FIG. 1H is shown with the polymer radome/stem removed from view. The antenna element 150 consists of a ground tube 156 and a radiating element 162. In an exemplary embodiment, both the ground tube and radiating element are formed from a conductive sheet metal material. Moreover, in an exemplary embodiment, the radiating element 162 is formed by three (3) shaped fins which, in conjunction with the ground tube 156, form a broadband conical dipole antenna element. Running within the ground tube is the coaxial feed 122 which feeds the horizontally polarized antenna element. Also located within the ground tube is a vertical coaxial cable 154 which feeds the vertically polarized antenna element. In one exemplary embodiment, the center conductor of the vertical coaxial cable 154 is coupled to the radiating element 162 via a solder joint located at a coupling location 160. While the use of solder is exemplary, it is appreciated that other attachment techniques such as via the use of well-known welding techniques and/or the use of conductive epoxy materials are also envisioned herein. The outer conductor for the vertical coaxial cable is further attached to ground tube 156 at coupling location 158. In one exemplary embodiment, the outer conductor of the vertical coaxial cable 154 is coupled to the ground tube 156 via a solder joint located at coupling location 158. However, while the use of solder is exemplary, it is appreciated that other attachment techniques such as via the use of well-known welding techniques and/or the use of conductive epoxy materials are also envisioned herein. Various performance aspects of the aforementioned MIMO antenna apparatus 100 are now shown and described in detail.

Broadband Omni-Directional Dual-Polarized MIMO Antenna Apparatus Performance—

Referring now to FIGS. 2-7D, exemplary performance results of the exemplary MIMO antenna apparatus illustrated with regards to FIGS. 1-1I are shown and described in detail.

Figure 2:
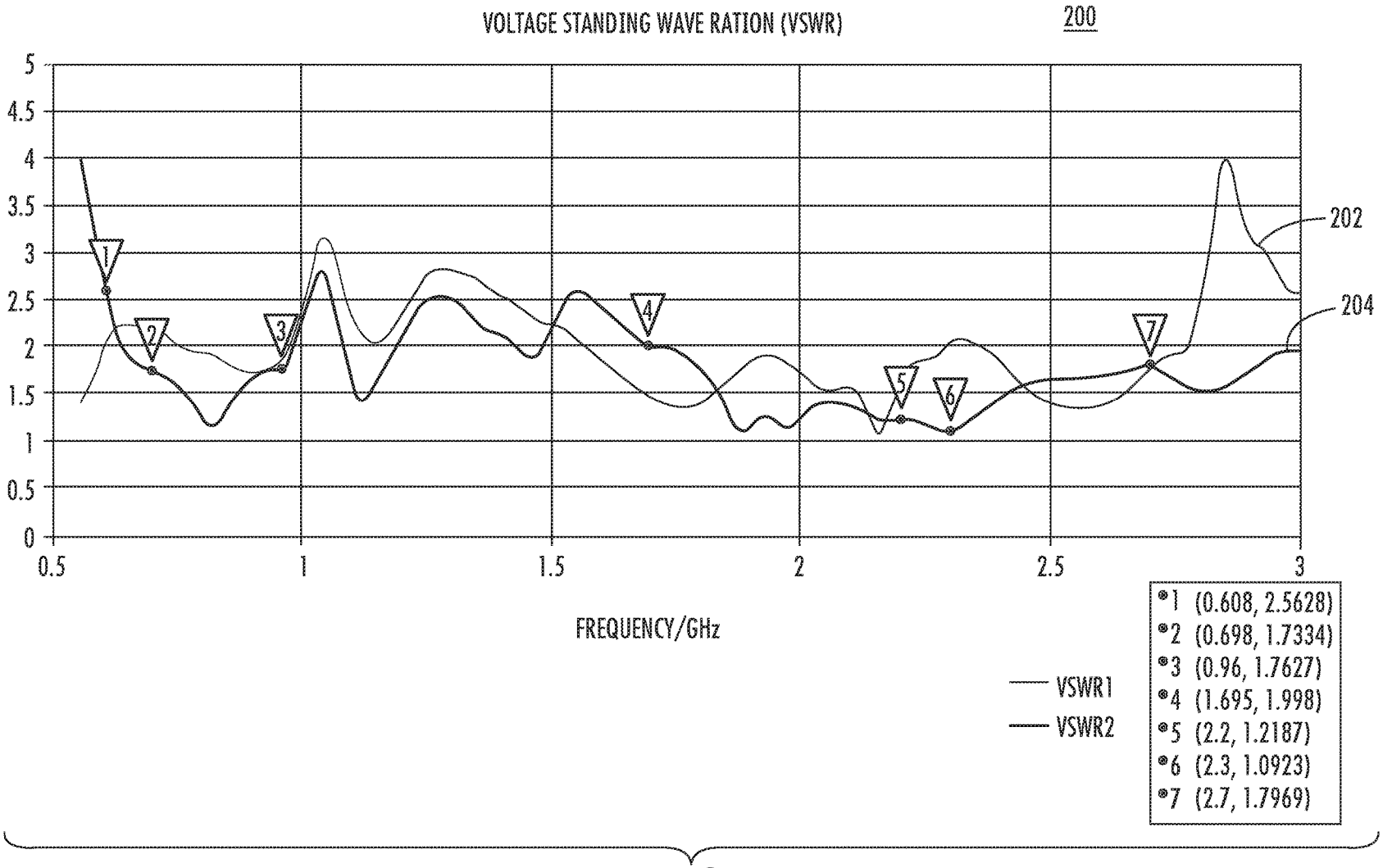
FIG. 2 is a plot of Voltage Standing Wave Ratio (VSWR) as a function of frequency for the MIMO antenna apparatus of FIG. 1 in accordance with the principles of the present disclosure.

FIG. 2 illustrates the Voltage Standing Wave Ratio ("VSWR") 200 for both the horizontally polarized antenna element (shown as line 202) as well as the vertically polarized antenna element (shown as line 204) as a function of frequency. In order for a radio device (whether a transmitter or receiver) to deliver power to an antenna, the impedance of the radio and transmission line must be well matched to the antenna's impedance. The parameter VSWR numerically describes how well the antenna is impedance matched to the radio and/or transmission line that it is connected to. Accordingly, lines 202, 204 illustrate VSWR values over the desired frequency range of approximately 608 MHz to 2700 MHz.

Figure 3:
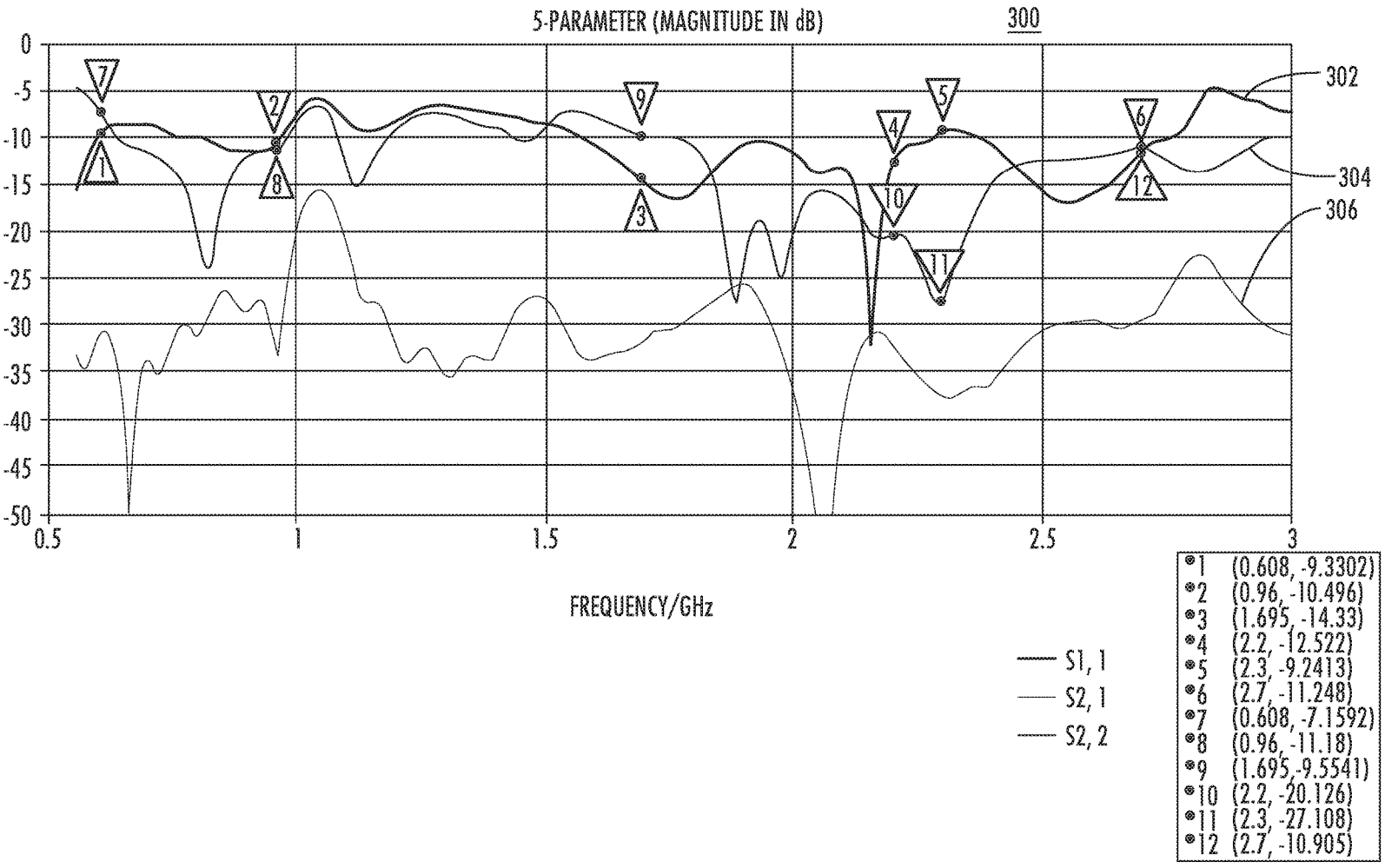
FIG. 3 is a plot of S-parameters as a function of frequency for the MIMO antenna apparatus of FIG. 1 in accordance with the principles of the present disclosure.

Referring now to FIG. 3, S-Parameter values as a function of frequency 300 are illustrated for the horizontally polarized antenna element (S1,1; 302), the vertically polarized antenna element (S2,2; 304) as well as isolation values (S2,1; 306) between the horizontally and vertically polarized antenna elements illustrated in FIGS. 1-1I.

Figure 4:
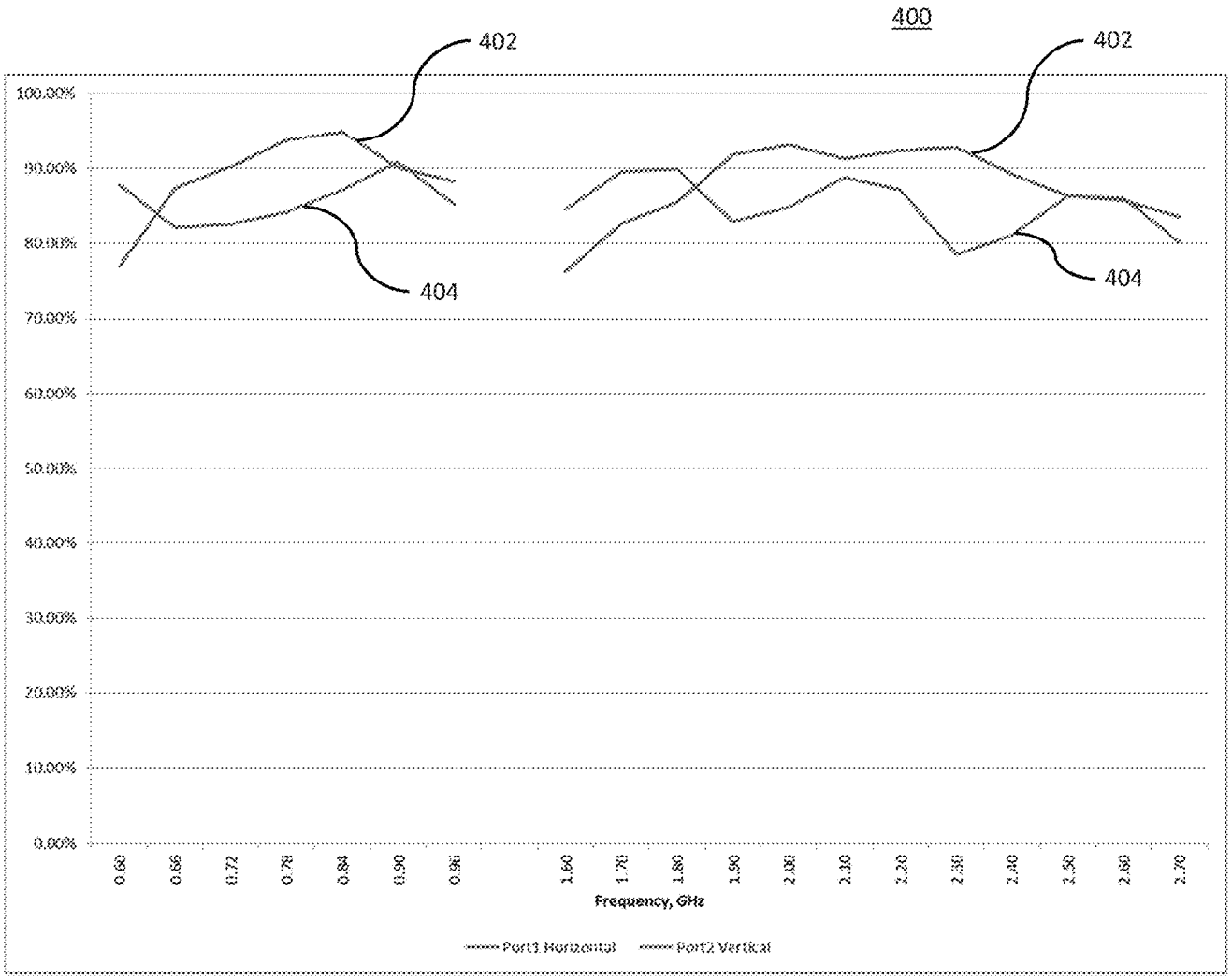
FIG. 4 is a plot of total efficiency as a function of frequency for the MIMO antenna apparatus of FIG. 1 in accordance with the principles of the present disclosure.

Referring now to FIG. 4, total efficiency as a function of frequency 400 is illustrated for both the vertically polarized antenna element as illustrated at line 402 as well as the horizontally polarized antenna element as illustrated at line 404.

Figure 5:
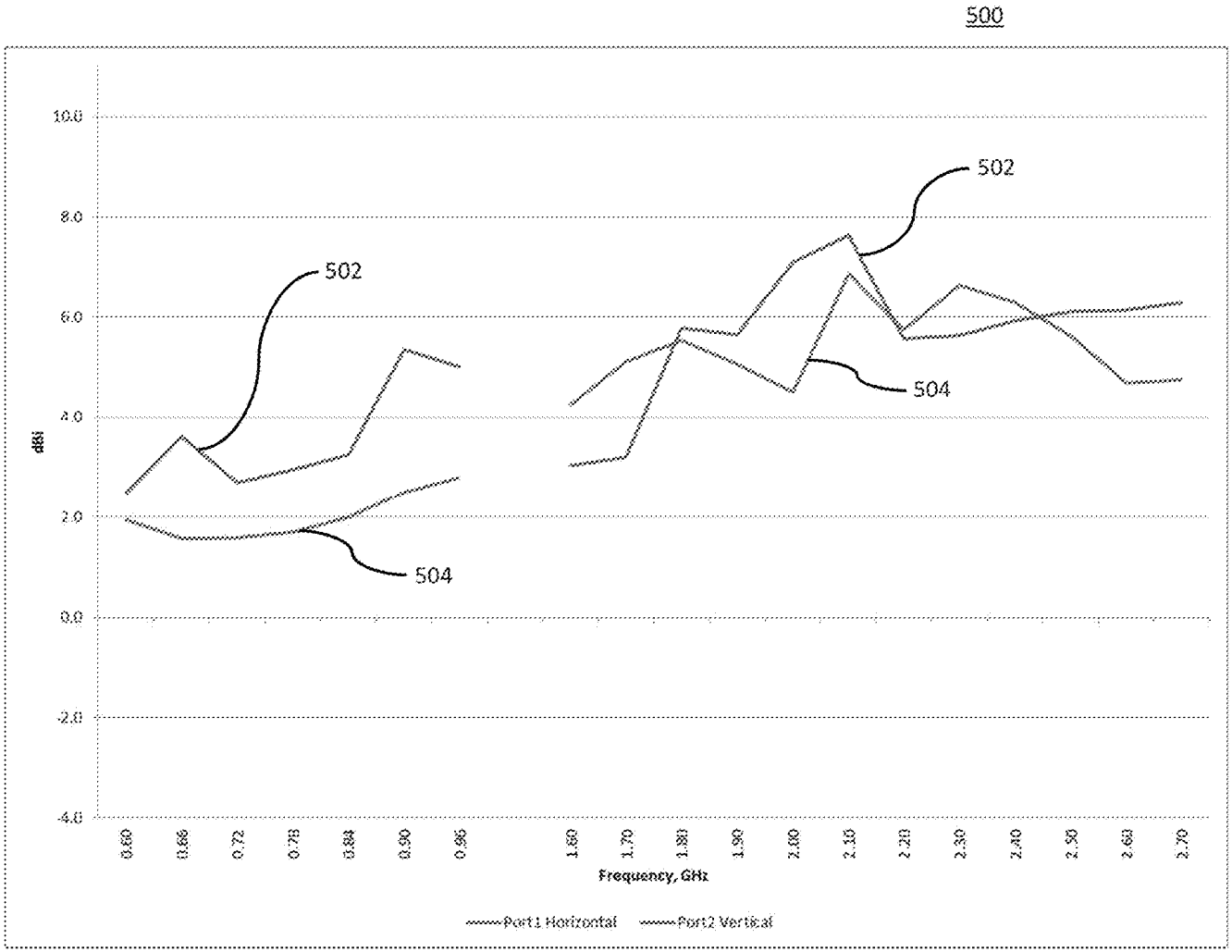
FIG. 5 is a plot of peak gain as a function of frequency for the MIMO antenna apparatus of FIG. 1 in accordance with the principles of the present disclosure.

Referring now to FIG. 5, peak gain as a function of frequency 500 is illustrated for both the vertically polarized antenna element as illustrated at line 502 as well as the horizontally polarized antenna element as illustrated at line 504.

Figure 6:
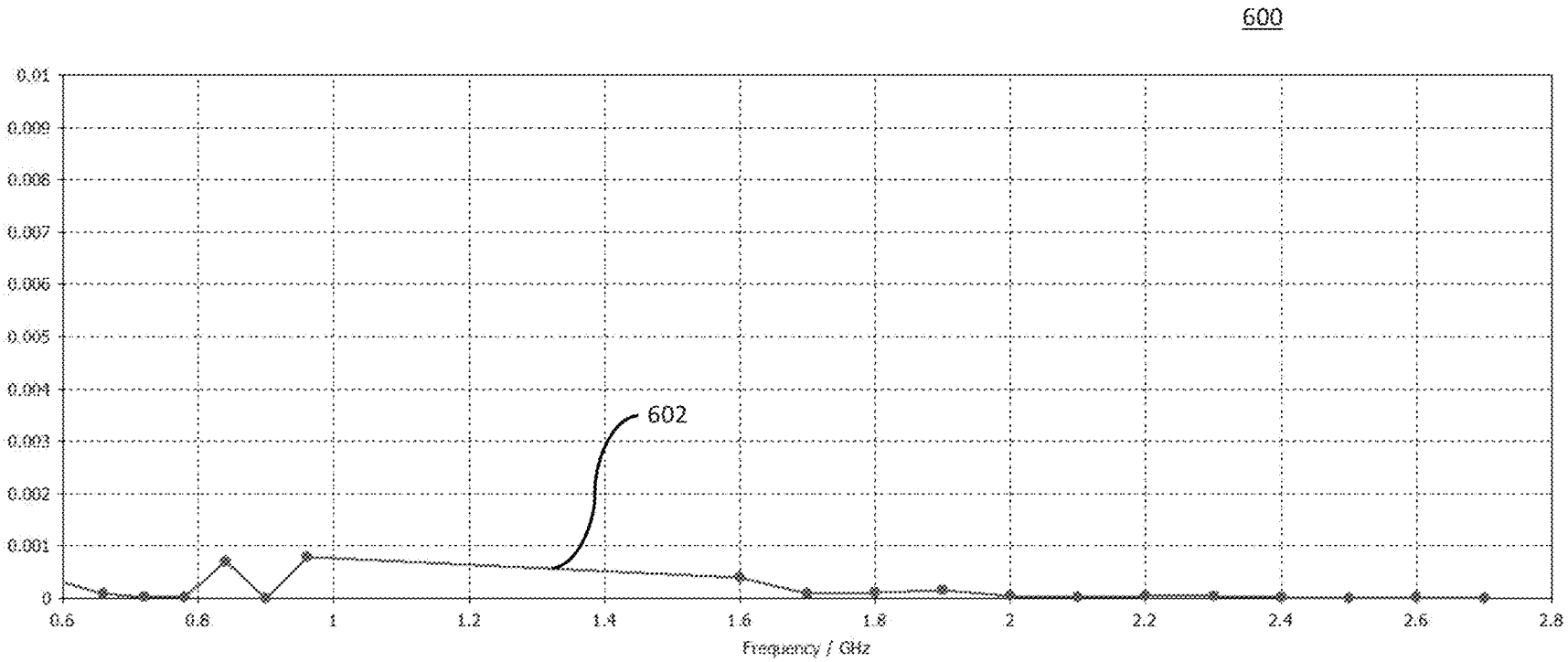
FIG. 6 is a plot of envelope correlation coefficient as a function of frequency for the MIMO antenna apparatus of FIG. 1 in accordance with the principles of the present disclosure.

Referring now to FIG. 6, the envelope correlation coefficient as a function of frequency 600 is illustrated for both the vertically polarized antenna element as well as the horizontally polarized antenna element. Specifically, the envelope correlation coefficient values are illustrated at line 602.

Figure 7A:
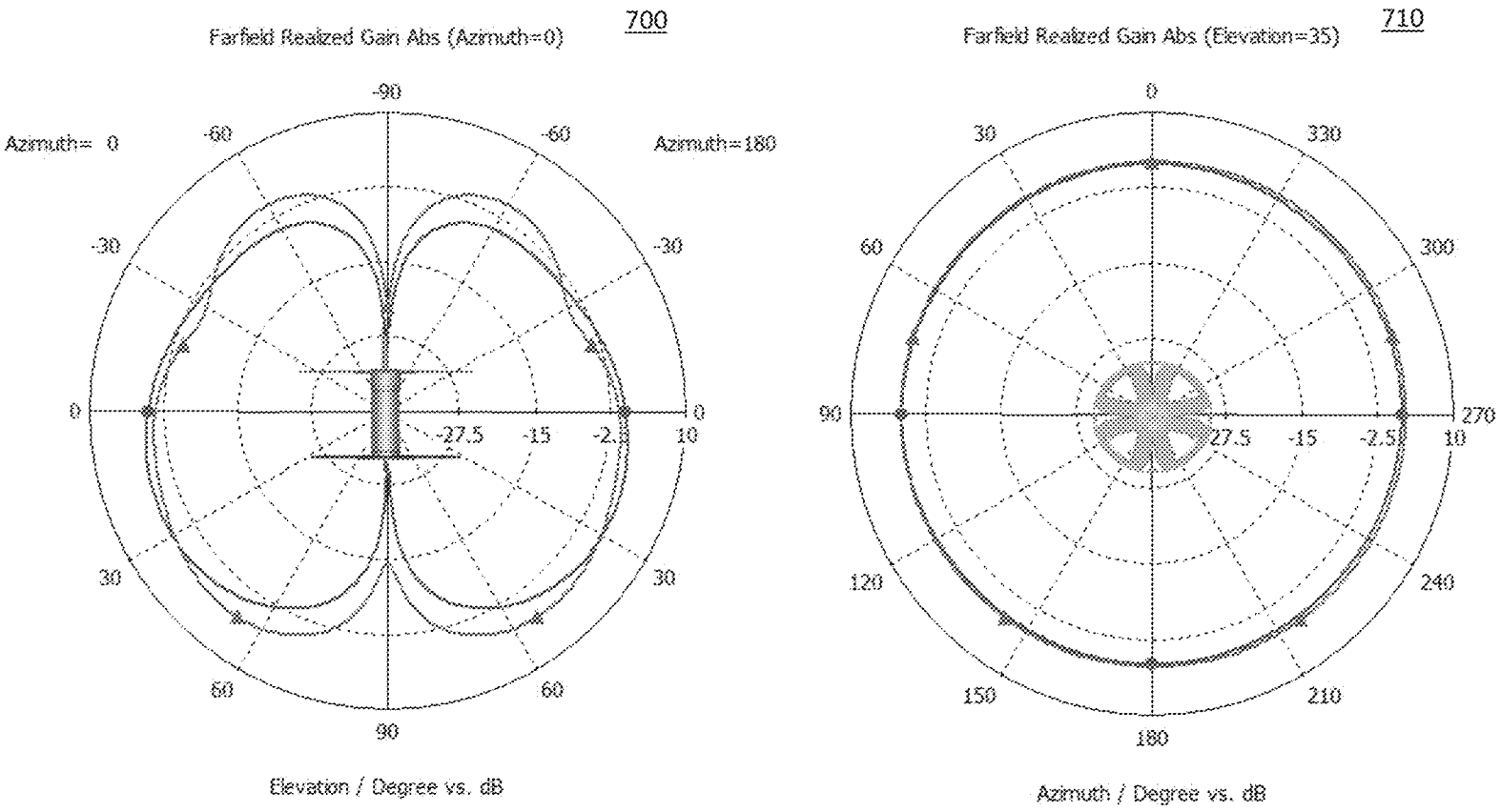
FIG. 7A are plots of radiation patterns at 720 MHz for the horizontally and vertically polarized antenna elements of FIG. 1A in accordance with the principles of the present disclosure.

Referring now to FIG. 7A, the omnidirectional radiation pattern of the MIMO antenna element illustrated in FIGS. 1-1I at 720 MHz is illustrated as both a function of elevation 700 as well as a function of azimuth 710 for both the horizontally polarized antenna element as well as the vertically polarized antenna element.

Figure 7B:
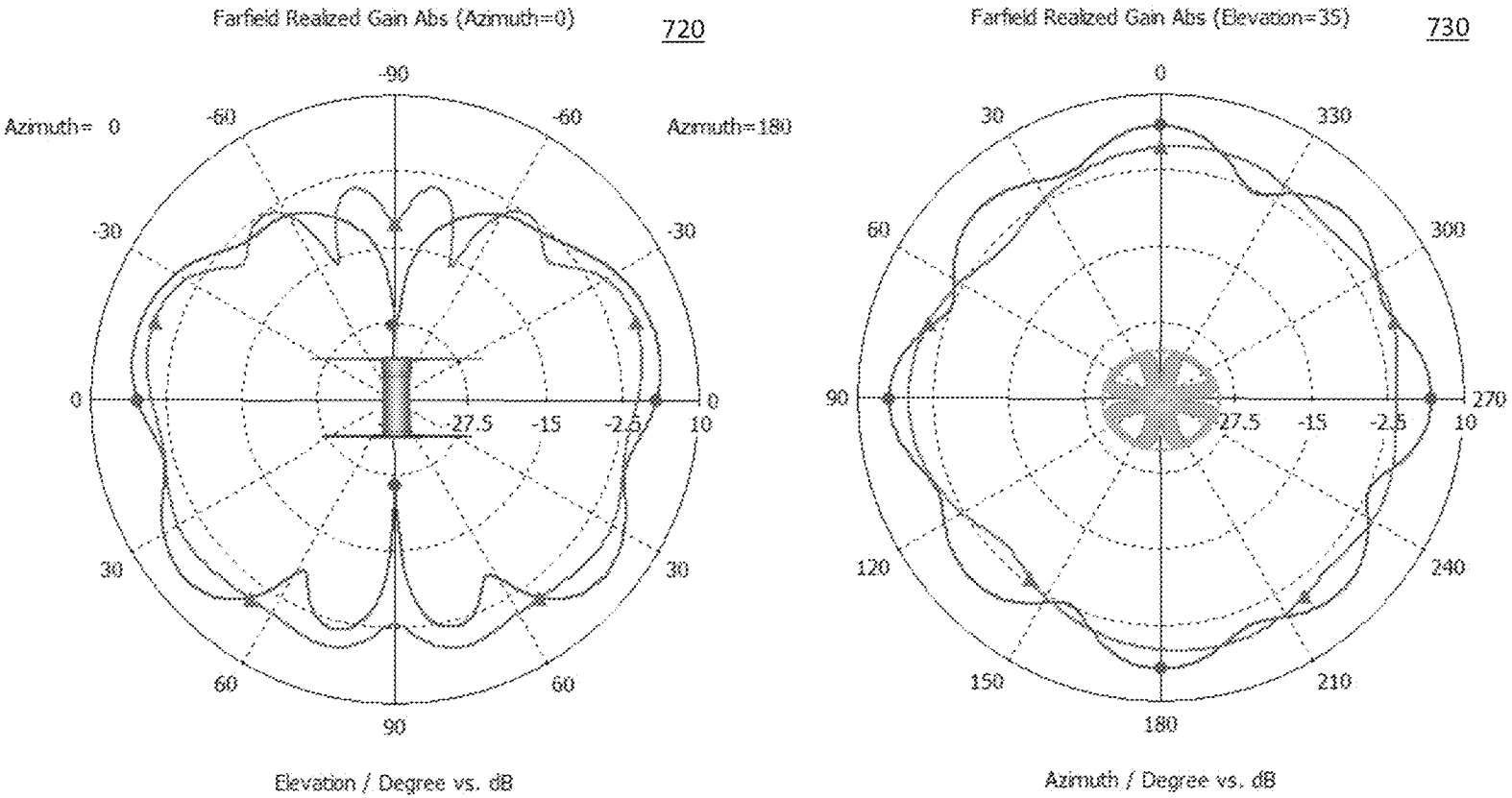
FIG. 7B are plots of radiation patterns at 1.70 GHz for the horizontally and vertically polarized antenna elements of FIG. 1A in accordance with the principles of the present disclosure.

Referring now to FIG. 7B, the omnidirectional radiation pattern of the MIMO antenna element illustrated in FIGS. 1-1I at 1.7 GHz is illustrated as both a function of elevation 720 as well as a function of azimuth 730 for both the horizontally polarized antenna element as well as the vertically polarized antenna element.

Figure 7C:
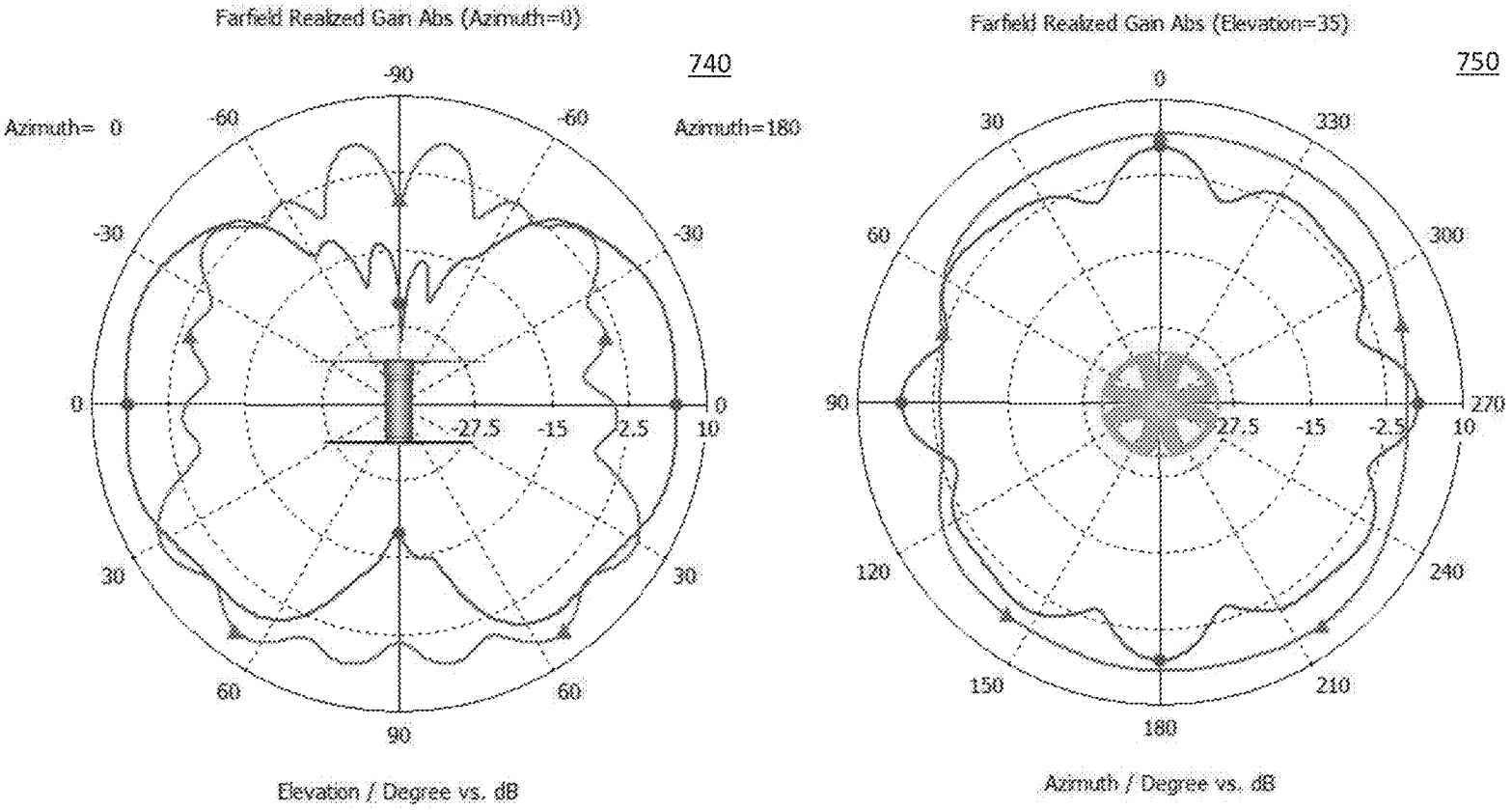
FIG. 7C are plots of radiation patterns at 2.20 GHz for the horizontally and vertically polarized antenna elements of FIG. 1A in accordance with the principles of the present disclosure.

Referring now to FIG. 7C, the omnidirectional radiation pattern of the MIMO antenna element illustrated in FIGS. 1-1I at 2.2 GHz is illustrated as both a function of elevation 740 as well as a function of azimuth 750 for both the horizontally polarized antenna element as well as the vertically polarized antenna element.

Figure 7D:
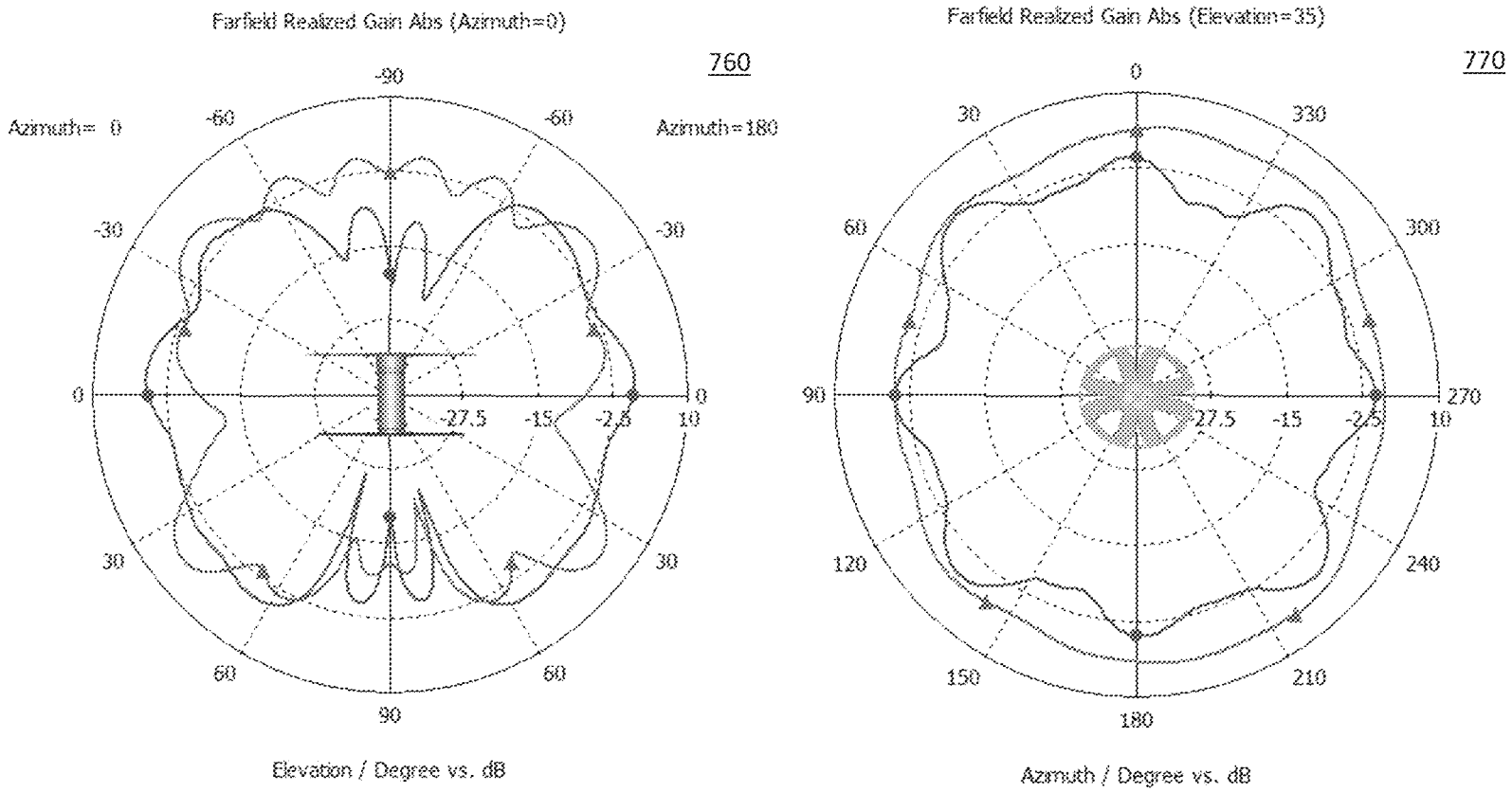
FIG. 7D are plots of radiation patterns at 2.70 GHz for the horizontally and vertically polarized antenna elements of FIG. 1A in accordance with the principles of the present disclosure.

Referring now to FIG. 7D, the omnidirectional radiation pattern of the MIMO antenna element illustrated in FIGS. 1-1I at 2.7 GHz is illustrated as both a function of elevation 760 as well as a function of azimuth 770 for both the horizontally polarized antenna element as well as the vertically polarized antenna element.

It will be recognized that while certain aspects of the present disclosure are described in terms of specific design examples, these descriptions are only illustrative of the broader methods of the disclosure, and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure described and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the principles of the present disclosure. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

What is claimed is:

1. A multiple-in multiple-out (MIMO) antenna apparatus, comprising:

a vertically polarized antenna element; and a horizontally polarized antenna element;

wherein the horizontally polarized antenna element comprises:

a translucent material that enables at least a portion of the horizontally polarized antenna element to meet an aesthetical design goal;

a plurality of broadband array elements, each broadband array element comprising a plurality of low band dipole elements; and a plurality of high band apertures, each of the plurality of high band apertures being positioned between adjacently disposed low band dipole elements.

2. The MIMO antenna apparatus of claim 1, wherein the horizontally polarized antenna element comprises a plurality of layers of material, the plurality of layers comprising a top radome layer, a bottom radome layer and a flexible printed circuit (FPC) layer disposed between the top and bottom radome layers.

3. The MIMO antenna apparatus of claim 2, wherein the top and bottom radome layers are secured to the FPC layer without use of an adhesive.

4. The MIMO antenna apparatus of claim 1, wherein the horizontally polarized antenna element comprises a radiator mesh disposed within a flexible printed circuit (FPC) layer.

5. The MIMO antenna apparatus of claim 4, wherein the radiator mesh comprises a plurality of lines comprising a line width, with the plurality of lines being separated from one another via a pitch.

6. The MIMO antenna apparatus of claim 1, further comprising a plurality of null filling dipole elements, each null filling dipole element being disposed within a respective one of the plurality of high band apertures.

7. The MIMO antenna apparatus of claim 1, wherein the vertically polarized antenna element comprises a broadband conical dipole antenna element disposed within a radome stem.

8. The MIMO antenna apparatus of claim 7, wherein the radome stem of the vertically polarized antenna element is configured to be received and secured within a mounting hole of a ceiling tile.

9. The MIMO antenna apparatus of claim 8, wherein the vertically polarized antenna element is configured to be positioned above a bottom surface of the ceiling tile such that when the tile is installed in a ceiling, the vertically polarized antenna element is not viewable from below the ceiling, while the horizontally polarized antenna element is configured to be positioned below the bottom surface of the ceiling tile.

10. A multiple-in multiple-out (MIMO) antenna apparatus, comprising:

a vertically polarized antenna element; and a horizontally polarized antenna element;

wherein the horizontally polarized antenna element comprises a translucent material that enables at least a portion of the horizontally polarized antenna element to meet an aesthetical design goal; and wherein the vertically polarized antenna element comprises a broadband conical dipole antenna element disposed within a radome stem.

11. The MIMO antenna apparatus of claim 10, wherein the horizontally polarized antenna element comprises a plurality of layers of material, the plurality of layers comprising a top radome layer, a bottom radome layer and a flexible printed circuit (FPC) layer disposed between the top and bottom radome layers.

12. The MIMO antenna apparatus of claim 11, wherein the top and bottom radome layers are secured to the FPC layer without use of an adhesive.

13. The MIMO antenna apparatus of claim 10, wherein the horizontally polarized antenna element comprises a radiator mesh disposed within a flexible printed circuit (FPC) layer.

14. The MIMO antenna apparatus of claim 13, wherein the radiator mesh comprises a plurality of lines comprising a line width, with the plurality of lines being separated from one another via a pitch.

15. The MIMO antenna apparatus of claim 10, wherein the horizontally polarized antenna element comprises a plurality of broadband array elements, each broadband array element comprising a plurality of low band dipole elements.

16. The MIMO antenna apparatus of claim 15, wherein the horizontally polarized antenna element further comprises a plurality of high band apertures, each of the plurality of high band apertures being positioned between adjacently disposed low band dipole elements.

17. The MIMO antenna apparatus of claim 16, further comprising a plurality of null filling dipole elements, each null filling dipole element being disposed within a respective one of the plurality of high band apertures.

18. The MIMO antenna apparatus of claim 10, wherein the radome stem of the vertically polarized antenna element is configured to be received and secured within a mounting hole of a ceiling tile.

19. The MIMO antenna apparatus of claim 18, wherein the vertically polarized antenna element is configured to be positioned above a bottom surface of the ceiling tile such that when the tile is installed in a ceiling, the vertically polarized antenna element is not viewable from below the ceiling, while the horizontally polarized antenna element is configured to be positioned below the bottom surface of the ceiling tile.

20. An antenna apparatus, comprising:

an antenna element formed from a plurality of layers of material and having a plurality of features disposed within at least some of the plurality of layers of material;

a low passive intermodulation (PIM) layer, the low PIM layer disposed underneath both the top and bottom radome layers;

wherein at least a portion of the plurality of layers are formed in part using a translucent polymer layer;

wherein the plurality of layers of material comprises a top radome layer, a bottom radome layer and a circuit board layer disposed between the top and bottom radome layers;

wherein the top and bottom radome layers are configured to sandwich the circuit board layer without use of an adhesive; and wherein the low PIM layer includes one or more transmission lines disposed on a bottom surface thereof, the one or more transmission lines being coupled to a feed point.

21. The antenna apparatus of claim 20, further comprising one or more open patch elements disposed on a top surface of the low PIM layer, the top surface of the low PIM layer being more proximate to the circuit board layer than the bottom surface of the low PIM layer.

22. The antenna apparatus of claim 21, further comprising a radiator mesh disposed on the circuit board layer.

23. A multiple-in multiple-out (MIMO) antenna apparatus, comprising:

a vertically polarized antenna element; and a horizontally polarized antenna element;

wherein the horizontally polarized antenna element comprises a plurality of layers and further comprising a plurality of features disposed within at least some of the plurality of layers;

wherein the plurality of layers comprise:

a top radome layer;

a circuit board layer comprising a radiating mesh;

a bottom radome layer; and a low PIM substrate layer.

24. The MIMO antenna apparatus of claim 23, further comprising a coaxial feed element having an outer conductor and an inner conductor;

wherein the outer conductor is electrically coupled to the circuit board layer and the inner conductor is electrically coupled to the low PIM substrate layer.

* * * * *